US005358230A

United States Patent [19]

Ikemori et al.

[11] Patent Number: 5,358,230

[45] Date of Patent: Oct. 25, 1994

[54] SHEET SUPPLYING APPARATUS

[75] Inventors: Ikuo Ikemori, Kawasaki; Katsuyuki Yokoi, Yokohama; Hiroyuki Ishii, Toride; Hiroyuki Inoue; Masao Ando, both of Yokohama; Ryukichi Inoue, Toride, all of Japan

[73] Assignee: Canon Kabushiki Kaisha, Tokyo, Japan

[21] Appl. No.: 49,360

[22] Filed: Apr. 21, 1993

[30] Foreign Application Priority Data

Apr. 24, 1992 [JP] Japan ..... 4-131888
Jul. 30, 1992 [JP] Japan ..... 4-222224

[51] Int. Cl.[5] ..... B65H 3/06

[52] U.S. Cl. ..... 271/114; 271/118; 271/119; 271/121; 271/127

[58] Field of Search ..... 271/114, 116, 117, 118, 271/119, 121, 126, 127

[56] References Cited

U.S. PATENT DOCUMENTS

| | | | |
|---|---|---|---|
| 4,717,139 | 1/1988 | Sootome et al. | 271/116 |
| 5,055,756 | 10/1991 | Ohkoda et al. | 318/618 |
| 5,201,873 | 4/1993 | Kikuchi et al. | 271/117 X |
| 5,219,155 | 6/1993 | Kanome | 271/127 X |
| 5,223,858 | 6/1993 | Yokoi et al. | 346/134 |
| 5,253,854 | 10/1993 | Tanoue et al. | 271/127 X |

FOREIGN PATENT DOCUMENTS

| | | | |
|---|---|---|---|
| 0464785 | 1/1992 | European Pat. Off. . | |
| 0464815 | 1/1992 | European Pat. Off. | 271/117 |
| 57-189945 | 11/1982 | Japan . | |
| 0183535 | 10/1983 | Japan | 271/126 |
| 61-238626 | 10/1986 | Japan . | |
| 0191337 | 8/1987 | Japan | 271/119 |
| 0193830 | 7/1990 | Japan | 271/114 |

OTHER PUBLICATIONS

IBM Technical Disclosure Bulletin, Sheet Feed Mechanism, vol. 30, No. 5, Oct. 1987, Armonk, N.Y., U.S.A.

*Primary Examiner*—H. Grant Skaggs
*Assistant Examiner*—Carol L. Druzbick
*Attorney, Agent, or Firm*—Fitzpatrick, Cella, Harper & Scinto

[57] ABSTRACT

The present invention provides a sheet supplying apparatus with a sheet support for supporting a sheet and shiftable between a supply position and a waiting position, a supply roller for feeding out the sheet from the sheet support means at the supply position, a biasing device for biasing the sheet support means from the waiting position toward the supply position, a shifting device for shifting the sheet supporting means from the supply position to the waiting position in adherence with a biasing force of the biasing device means, and a regulating apparatus for regulating the shifting of the sheet support means with a force weaker than the biasing device force of the biasing device, when the sheet support means shifted to the waiting position by the shifting device is shifted from the waiting position to the supply position by the biasing device.

16 Claims, 20 Drawing Sheets

SHEET SUPPLYING APPARATUS

BACKGROUND OF THE INVENTION

1. Field of the Invention

The present invention relates to a sheet supplying apparatus used with an image forming apparatus such as a laser beam printer, an ink jet printer, a copying machine, a facsimile apparatus and the like.

2. Related Background Art

In the past, there has been proposed a sheet supplying apparatus wherein a sheet stacking plate on which a plurality of sheets are stacked is lifted and lowered between a waiting position and a supply position, and an uppermost sheet is feed out by a sheet supply roller at the supply position. In some of such sheet supplying apparatuses, the sheet stacking plate is biased toward the supply position by a spring and the like, and the sheet stacking plate is lowered to the waiting position in opposition to the biasing force of the spring by a cam secured to a shaft of the sheet supply roller when this roller is rotated.

In such apparatus, in an operative condition, whenever the sheet is supplied one by one, the sheet stacking plate is shifted from the supply position to the waiting position, and in an inoperative condition, the sheet stacking plate is held in the waiting position to facilitate the replenishment of sheets or the like.

Generally, the sheet stacking plate is held in the waiting position by a means for interrupting the transmission of a rotational force to the shaft of the sheet supply roller, and a stopper capable of stopping the sheet stacking plate at the lowered position. By releasing the stopping action of the stopper and the interruption of the transmission of the rotational force to the sheet supply roller, the cam is rotated to shift the sheet stacking plate from the waiting position to the supply position, thereby permitting the sheet supplying operation.

The concrete construction will be described hereinbelow.

In FIG. 28, a plurality of sheets S are stacked on a sheet stacking plate 151 which is biased by a spring 153 so that the sheet stack can be urged against a sheet supply roller 152 for supplying a sheet S. Further, a friction member 154 as a separation means disposed in front of a front end of the sheet stacking plate 151 is biased by a spring 155 so that the friction member can be abutted against the sheet supply roller 152. The sheets S supplied from the sheet stacking plate 151 to the sheet supply roller 152 are separated one by one by the friction member 154.

A cam 156 is secured to a shaft 152*a* of the sheet supply roller 152, which cam can be abutted against the sheet stacking plate 151. The cam 156 is rotated as the sheet supply roller 152 is rotated, thereby shifting the sheet stacking plate between a waiting position and a supply position. That is to say, the sheet stacking plate 151 can be shifted between the waiting position (condition shown in FIG. 28) where the sheet stacking plate 151 is lowered by the cam 156 in opposition to the biasing force of the spring 153 and the supply position where the cam 156 is separated from the sheet stacking plate 151 and the sheet stack is urged against the sheet supply roller 152.

A rotational force of a motor M is transmitted to the sheet supply roller 152 by a gear 157 secured to the roller shaft 152*a* and a gear 158 meshed with the gear 157 and connected to the motor M. The gear 157 has a cut-out portion 157*a*. When the cut-out portion 157*a* faces the gear 158, the rotational force is not transmitted to the sheet supply roller.

Further, the cam is subjected to a force from the sheet stacking plate 151 by the spring 153 for biasing the sheet stacking plate 151 so that the cam is rotated in a clockwise direction in FIG. 28. However, the cam can be held in the waiting position by a stopper 159. The stopper 159 comprises a regulating member 161 engaged by a regulating cam 160 and adapted to regulate the rotation of the roller shaft 152*a*, and an electromagnet 162 for shifting the regulating member 161 between a regulating position and a non-regulating position.

The operation of this apparatus will be briefly explained hereinbelow.

FIG. 28 shows the waiting condition of the sheet stacking plate 151. When a signal such as a sheet supply signal is inputted to the apparatus, the electromagnet 162 is operated to disengage the regulating member 161 from the regulating cam 160. As a result, the cam 156 is rotated in the clockwise direction in FIG. 28 by the spring 153 via the sheet stacking plate 151. Further, in the waiting condition, since the cut-out portion 157*a* of the gear 157 faces the gear 158, the rotational force of the motor M is not transmitted to the sheet supply roller 152. However, when the cam is rotated by releasing the regulating member 161, the gear 157 is engaged by the gear 158, with the result that the rotational force is transmitted to the sheet supply roller 152. The sheet stacking plate 151 is lifted to urge the sheet stack S against the sheet supply roller 152, thereby feeding out the sheet.

When the cam 156 is rotated by one revolution, since the cut-out portion 157*a* of the gear 157 faces the gear 158 again, the transmission of the rotational force is interrupted. In this case, when the electromagnet 162 is in an inoperative condition, the cam 156 is stopped by the regulating member 161, thereby bringing the sheet stacking plate 151 to the waiting condition shown in FIG. 28.

Incidentally, in the above example, while the transmission of the rotational force is controlled by the combination of the gear 157 having the cut-out portion and the gear 158, a spring clutch for effecting one-revolution control may be used.

The spring clutch is conventionally used and is provided on the drive shaft of the sheet supply roller, so that the rotational force of the motor is transmitted to or interrupted from the drive shaft by tightening or loosening a coil spring of the spring clutch.

However, in the above-mentioned sheet supplying apparatus has the following disadvantages.

In the case where the transmission of the rotational force is controlled by the combination of the gear 157 having the cut-out portion and the gear 158, if the rotational speed of the gear 157 is faster than the rotational speed of the gear 158 when the gear 157 is engaged by the gear 158 after the idle rotation of the cut-out portion 157*a* in consequence of the clockwise rotation of the cam 156 by the spring 153 for biasing the sheet stacking plate 151, the great torque will be transmitted from the gear 157 to the motor M, thus affecting a bad influence upon the motor M, or making the feeding speed of a convey roller 163 unstable due to fluctuation in the rotational speed of the motor M caused by the variation of torque when the convey roller 163 is driven by the same motor M.

Further, in the case where the spring clutch is used, since the sheet stacking plate 151 biases the cam 156 thereby to push the roller shaft 152*a* toward the rotation direction of the sheet supply roller 152, the spring clutch is loosened or untightened, and, therefore, the rotational speed of the shaft 152*a* becomes greater than the rotational speed of the motor accordingly. This occurs acceleratively, thereby increasing the lifting speed of the sheet stacking plate 151, with the result that the sheet stack S rested on the sheet stacking plate 151 is struck against the sheet supply roller 152, thereby applying the great fluctuation of load to the motor M or generating the great striking noise.

SUMMARY OF THE INVENTION

The present invention aims to eliminate the above-mentioned conventional drawback, and an object of the present invention is to prevent the occurrence of the fluctuation on load of a motor and the great striking noise which may caused when a sheet stacking plate is abutted against a sheet supply roller when the stacking plate is lifted.

According to the present invention, there is provided a sheet supplying apparatus comprising a sheet supporting means for supporting a sheet and shiftable between a supply position and a waiting position, a supply means for feeding out the sheet from the sheet supporting means at the supply position, a biasing means for biasing the sheet supporting means from the waiting position toward the supply position, a shifting means for shifting the sheet supporting means from the supply position to the waiting position in opposition to a biasing force of the biasing means, and a regulating means for regulating the shifting of the sheet supporting means with a force weaker than the biasing force of the biasing means, when the sheet supporting means shifted to the waiting position by the shifting means is shifted from the waiting position to the supply position by the biasing means.

With this arrangement, since the biasing force of the biasing means is reduced by the regulating means when the sheet supporting means is shifted from the waiting position to the supply position by the biasing means, the shifting speed of the sheet supporting means can be reduced, thereby reducing a force that the sheet supporting means is struck against the supply means and the like. In this way, it is possible to reduce the fluctuation in the load and the striking noise.

DETAILED DESCRIPTION OF THE PREFERRED EMBODIMENTS

Figure 1:
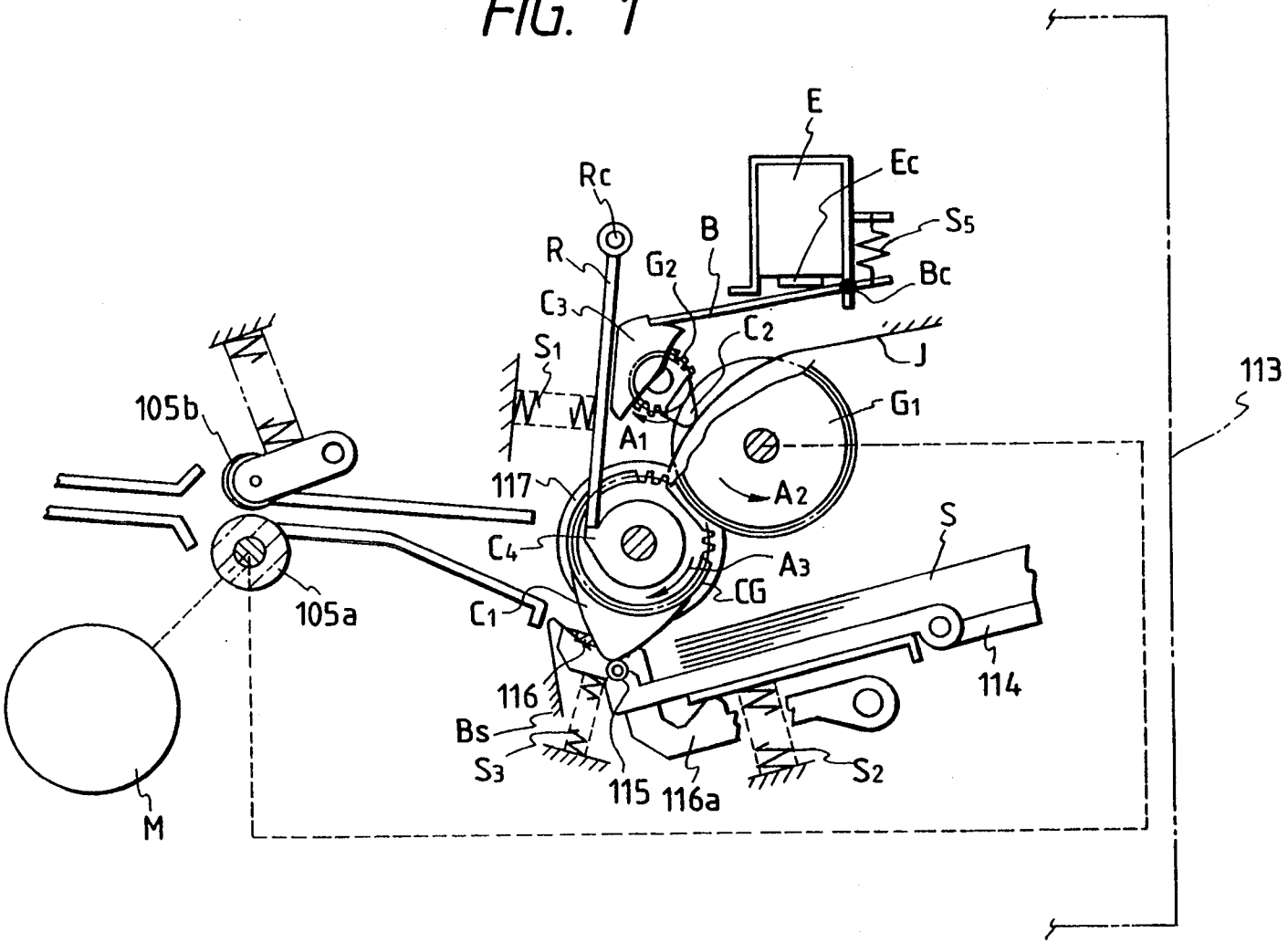
FIG. 1 is a sectional side view of a sheet supplying apparatus according to a preferred embodiment of the present invention.
Figure 2:
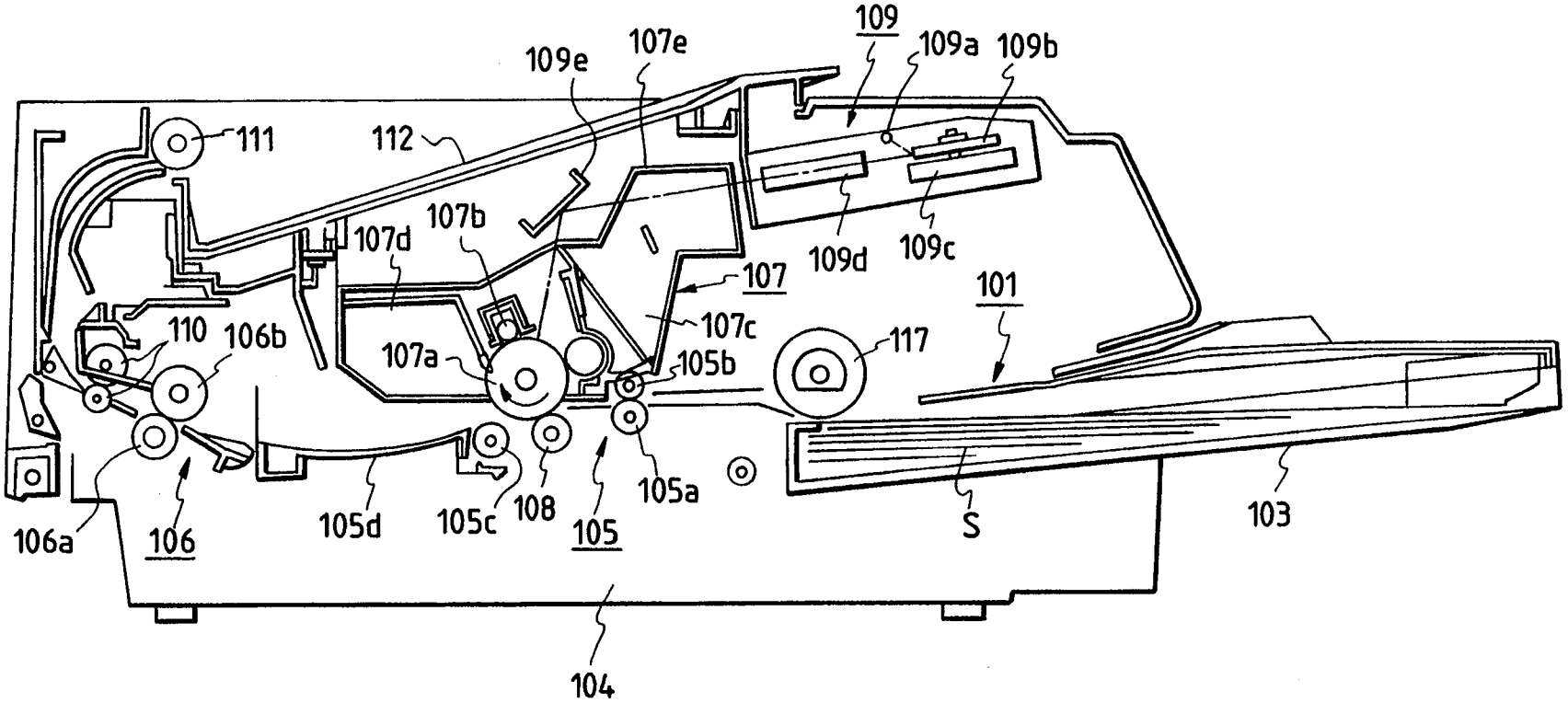
FIG. 2 is an elevational sectional view of a laser beam printer having the sheet supplying apparatus of FIG. 1.

A sheet supplying apparatus according to a preferred embodiment of the present invention will now be explained with reference to the accompanying drawings. FIG. 1 is a sectional view of a sheet supplying apparatus, and FIG. 2 is an elevational sectional view of a laser beam printer having such sheet supplying apparatus. First of all, various portions of the laser beam printer (image forming apparatus) will be explained with reference to FIG. 2.

(Sheet Supply Portion)

A sheet supply portion 101 serves to supply a sheet S to an image forming portion, and a sheet supply cassette 103 containing a plurality of sheets S is inserted into a body 104 of the printer at the sheet supply portion. In an image forming operation, a sheet supply roller (supply means) 117 is rotated in response to the image forming operation to separate the sheets S in the cassette 103 one by one and supply the separated sheet.

(Convey Means)

A convey means 105 serves to convey the sheet S supplied from the sheet supply portion 101 and to convey the sheet to a fixing portion 106. That is to say, the sheet S separated and supplied from the sheet supply portion 101 is conveyed at the proper timing by a pair of regist rollers 105*a*, 105*b*, and the sheet S on which an image was formed is conveyed to the fixing portion 106 by a convey roller 105*c* and a guide plate 105*d*.

Next, explaining a process cartridge constituting an image forming means, the process cartridge comprises an image bearing member, and at least one process means. The process means may be a charger means for charging a surface of the image bearing member, a developing means for forming a toner image on the image bearing member, a cleaning means for removing residual toner from the surface of the image bearing member and the like. In the process cartridge 107 according to the illustrated embodiment, a charger means 107*b*, a developing means 107*c* containing toner (developer), and a cleaning means 107*d* are arranged around an electrophotographic photosensitive drum 107*a*, and these means are enclosed by a cartridge cover 108*e* to provide a cartridge unit which can be removably mounted to the body 104 of the image forming apparatus.

(Transfer Means)

A transfer means serves to transfer the toner image formed on the photosensitive drum 107*a* onto the sheet S, and comprises a transfer roller 108. That is to say, transfer means is so designed that the sheet S is urged against the photosensitive drum 107*a* of the mounted process cartridge 107 by the transfer roller 108, and, by applying voltage having the polarity opposite to that of the toner to the transfer roller, the toner image on the photosensitive drum 107*a* is transferred onto the sheet S.

(Fixing Portion)

The fixing portion 106 serves to fix the image formed on the sheet S sent from the transfer roller 108, and comprises a drive roller 106*a* and a fixing roller 106*b* urged against the drive roller and adapted to apply heat and pressure. That is to say, while the sheet S separated from the transfer roller 108 is being passed through the fixing portion 106, the sheet S is shifted by the drive roller 106*a*, and the heat and pressure is applied to the sheet by the fixing roller 106*b*, thereby fixing toner image to the sheet S.

The exposure of the image forming portion of the process cartridge 107 is effected by a scanner portion 109. That is to say, when an image signal is applied to a laser diode 109*a*, the laser diode 109*a* emits image light corresponding to the image signal to a polygon mirror 109*b*. The polygon mirror 109*b* is rotated at a high speed by a scanner motor 109*c*, and the image light reflected by the polygon mirror 109*b* is illuminated onto the photosensitive drum through the exposure portion of the process cartridge 107 via a focusing lens 109*d* and a reflection mirror 109*3*, thus selectively exposing the photosensitive drum.

(Discharge Portion)

After the fixing operation, the sheet S is discharged onto a discharge tray 112 with the imaged surface of the sheet facing downwardly, by discharge rollers 110, 111.

Next, the construction of the sheet supply portion 101 will be explained with reference to FIG. 1. The reference numeral 113 denotes a sheet supply unit comprising the following means,.

(Stacking Means)

A sheet stacking plate 114 capable of stacking the sheets S thereon is disposed on a bottom of the cassette 103 and can be lifted and lowered. The sheet stacking plate 114 is normally urged upwardly by a spring $S_2$ disposed below the sheet stacking plate. Further, a rotatable roller 115 is mounted on a front end of the sheet stacking plate 114 in a sheet supplying direction, which roller is abutted against a cam $C_1$ integrally formed with a sheet supply roller 117 which will be described later. Further, a separation member (separation means) 116 is disposed in front of the front end of the sheet stacking plate 114. The separation member 116 is supported by an arm 116*a* which is biased upwardly by a spring $S_3$, and the sheet stacking plate 114 is inclined upwardly.

(Supply Means)

The sheet supply roller 117 serves to supply the sheets S stacked on the sheet stacking plate 114 one by one from the uppermost one. In an inoperative condition, the sheet supply roller 117 is spaced apart from the sheet stacking plate 114 and the separation member 116; whereas, in an operative condition, the sheet supply roller 117 is urged against the sheet stack on the sheet stacking plate and the separation member, thereby separating the sheets S one by one.

(Drive Means)

A motor M constitutes a drive source and serves to drive the regist rollers 105*a*, 105*b* and a gear $G_1$ via a driving force transmission mechanism (not shown). The regist rollers 105*a*, 105*b* are rotated by receiving the driving force from the motor M at the proper timing, and the gear $G_1$ is rotated in a direction shown by the arrow $A_2$ at a constant speed.

(Driving Force Transmission Means and Lifting/Lowering Means)

An electromagnet E for effecting rotation control has a central iron core Ec and is designed so as to attract a control plate B when energized. The control plate B is pivotably attached to a holding member of the electromagnet E for pivotal movement around a pivot center Bc and is biased toward an anti-clockwise direction by a spring $S_5$ connecting between one end of the control plate B and the holding member.

A gear $G_2$ has a cut-out portion and is formed integrally with cams $C_2$, $C_3$. The gear $G_2$ can be rotated in the direction shown by the arrow $A_1$ by abutting the cam $C_2$ positioned in alignment with the cut-out portion against a curved leaf spring J, but is held stationary by engaging a free end of the control plate B by a shoulder of the cam $C_3$. Further, in the stationary condition, the cut-out portion of the gear $G_2$ faces the gear $G_1$. However, when the gear $G_2$ is rotated in the direction $A_1$, the gear $G_2$ is engaged by the gear $G_1$ to be driven by the gear $G_1$.

A rod R is pivotably supported for pivotal movement around a pivot center Rc. The rod R is biased toward an anti-clockwise direction by a spring $S_1$ and is locked on a cam $C_4$ integrally formed with the sheet supply roller 117 which will be described later. Incidentally, in the stationary condition of the gear $G_2$ having the cut-out portion, the cam $C_3$ is not abutted against the rod R.

A gear CG has a cut-out portion and is formed integrally with the sheet supply roller 117, cam $C_1$ and cam $C_4$. The cam $C_1$ constitutes a lifting/lowering means and serves to lift or lower the sheet stacking plate 114 by slidingly contacting with the roller 115 biased by the springs $S_2$, $S_3$ in synchronous with the transmission of the driving force to the sheet supply roller 117. The gear CG having the cut-out portion can be rotated in a direction shown by the arrow $A_3$ by pushing the cam $C_1$ by the roller 115 disposed at the front end of the sheet stacking plate 114, but is normally held stationary by locking the free end of the rod R to the shoulder of the cam $C_4$. Further, in the stationary condition, the cut-out portion of the gear CG faces the gear $G_1$. However, when the gear CG is rotated in the direction $A_3$, it is engaged by the gear $G_1$ to be driven by the gear $G_1$.

(Control Means)

A leaf spring Bs constitutes a control means and serves to reduce the acceleration of the cam $C_1$ when this cam is suddenly rotated in the direction $A_3$ by pushing the cam by the roller 115. When the cam $C_1$ is rotated in the direction $A_3$, this cam is abutted against the leaf spring Bs to reduce the acceleration of the cam by the elasticity of the leaf spring. In this regard, the leaf spring Bs has an elastic force not to obstruct the rotation of the cam $C_1$.

Next, the sheet supplying operation of the sheet supply unit 113 will be explained.

When the sheet supply signal for the sheet S is emitted from the image forming apparatus 104, the current is applied to the electromagnet E to activate the latter, with the result that the iron core Ec attracts the control-plate B, thereby rotating the control plate in the clockwise direction around the pivot center Bc. Consequently, the free end of the control plate B is disengaged from the cam $C_3$, with the result that the cam $C_2$ urged by the leaf spring J is rotated in the direction $A_1$, thereby rotating the cam $C_3$ and the gear $G_2$ coaxial with the gear $C_2$ in the direction $A_1$. When the cut-out portion of the gear $G_2$ is idly rotated and the gear $G_2$ is engaged by the gear $G_1$, the rotational force of the motor M is transmitted to the gear $G_2$, thereby rotating the gear $G_2$ together with the cams $C_2$, $C_3$.

When the cam $C_3$ is rotated in the direction $A_1$, the rod R is pushed in opposition to the biasing force of the spring $S_1$ to be rotated in the clockwise direction around the pivot center Rc, thereby disengaging the free end of the rod from the cam $C_4$. In this case, the roller 115 arranged at the front end of the sheet stacking plate 114 is pushed upwardly by the spring forces of the spring $S_2$ urging the sheet stacking plate and the spring $S_3$ urging the arm 116*a*, thereby rotating the cam $C_1$ in the direction $A_3$. Then, the cam $C_4$ and the gear CG coaxial with the cam $C_1$ start to rotate in the direction $A_3$.

In this case, the leaf spring Bs applies the force to the cam $C_1$ to regulate the rotation of this cam; however, the elastic force of the leaf spring Bs is sufficiently weaker than the urging force of the roller 115 urged by the springs $S_2$, $S_3$ for urging the sheet stacking plate 114. At the beginning of the rotation of the cam $C_1$, the leaf spring Bs acts to regulate the rotation of the cam; however, when the top of the cam $C_1$ passes through the maximum deflection point of the leaf spring, the leaf spring Bs acts to aid the rotation of the cam $C_1$. Further, when the cut-out portion of the gear CG is idly rotated and the gear CG is engaged by the gear $G_1$, the rotational force of the motor M is transmitted to the gear CG, whereby the gear CG is rotated together with the sheet supply roller 117 in the direction $A_3$. At the same time when the sheets S are fed out by the rotation of the sheet supply roller 117, the separation member 116 is urged against the sheet supply roller 117 by the spring $S_3$ to separate the sheets S one by one.

Then, when the electromagnet E is disenergized, the control plate B is rotated in the anti-clockwise direction around the pivot center Bc by the spring force of the spring $S_5$ to return to its original position. When the cam $C_3$ is rotated by one revolution, the free end of the control plate B is locked against the shoulder of the cam $C_3$ is stopped because the cut-out portion of this gear faces the gear $G_1$.

Further, since the rod R is not engaged by the cam $C_3$ when the cam $C_3$ is in the stationary condition, the rod is rotated in the anti-clockwise direction around the pivot center Rc by the spring force of the spring $S_1$ to return to its original position. In this case, the free end of the rod R is locked against the shoulder of the cam $C_4$, and the gear CG coaxial with the cam $C_4$ is stopped because the cut-out portion of the gear CG-faces the gear $G_1$ not to transmit the rotational force of the motor to the gear CG. Similarly, the sheet supply roller 117 is stopped. At the same time, the cam $C_1$ coaxial with the sheet supply roller 117 pushes down the roller 115 arranged at the front end of the sheet stacking plate 114. At the same time, the arm 116*a* urging the sheet stacking plate 114 is pushed down, thereby separating the sheet supply roller 117 from the separation member 116 and the sheet stacking plate 114. In this way, the supplying force for the sheet S is released.

With the arrangement as mentioned above, if there is no leaf spring Bs, when the rod R is disengaged from the cam $C_4$ by rotating in the clockwise direction around the pivot center Rc by the urging force of the cam $C_3$ after the electromagnet E is energized, the sheet supply roller 117 will be rotated in the direction $A_3$ with the greater acceleration by pushing the cam $C_1$ by the spring forces of the springs $S_2$, $S_3$ via the roller 115. As a result, the shock generated when the gear CG is engaged by the gear $G_1$ is also transmitted to the regist rollers 105*a*, 105*b* (driven by the same drive source), thereby making the conveying speed of the sheet S unstable temporarily. However, by utilizing the leaf spring Bs, it is possible to reduce the acceleration of the cam $C_1$ immediately after the sheet supplying operation is started, thereby reducing the rotation fluctuation of the convey means 105 driven by the same motor M to maintain the stable sheet conveying operation.

Figure 3:
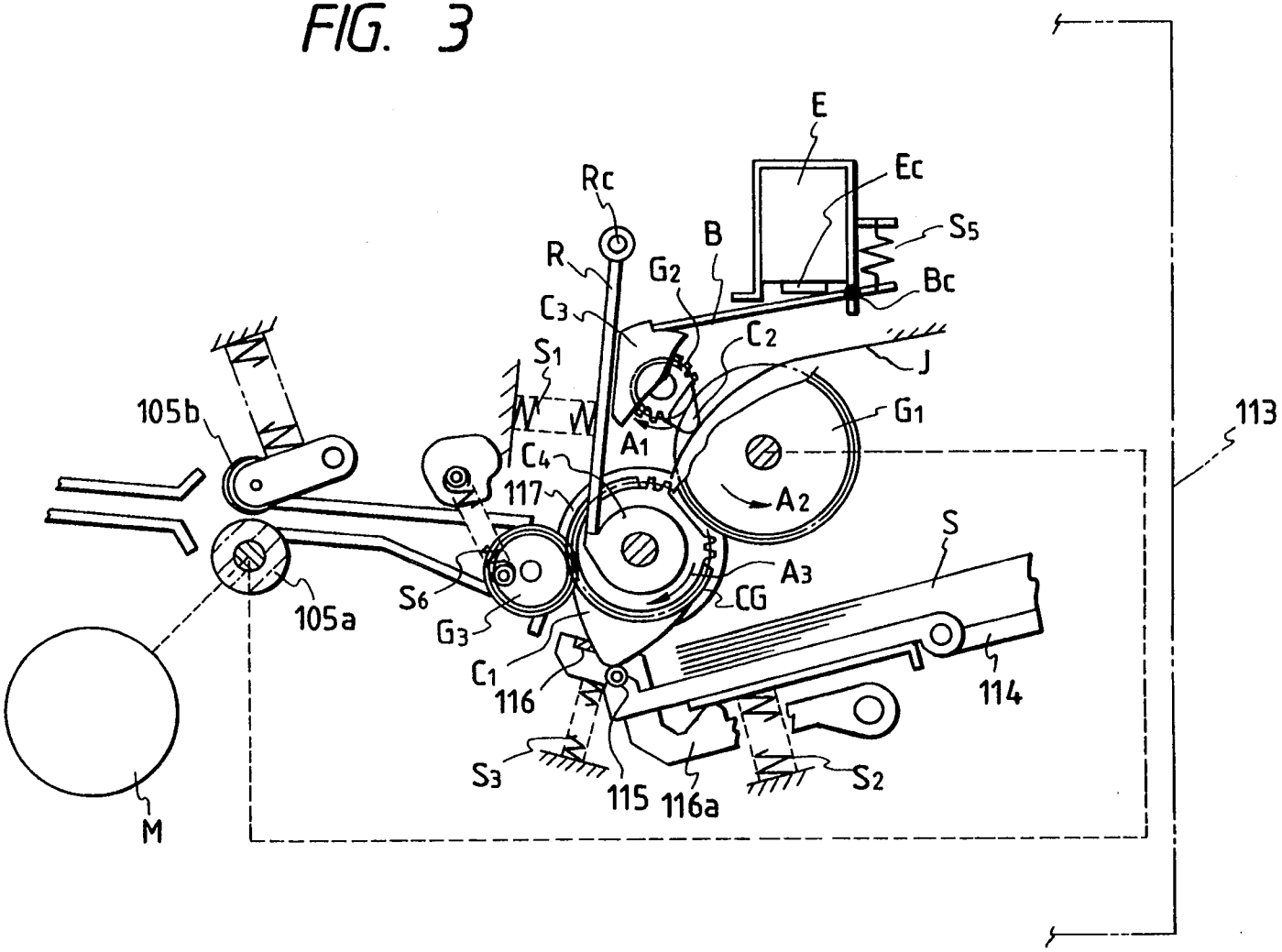
FIG. 3 is a sectional side view of a sheet supplying apparatus according to another embodiment of the present invention.

Next, a sheet supplying apparatus according to another embodiment will be explained with reference to FIG. 3. Since the general construction and sheet supplying operation of this sheet supplying apparatus are the same as those of the first embodiment, the same constructural elements are designated by the same reference numerals, and the explanation thereof will be omitted.

In this embodiment, as a control means, there is provided a gear $G_3$ which can be engaged by the gear CG (having the cut-out portion) integrally formed with the sheet supply roller 117. A spring $S_6$ is connected to a side surface of the gear $G_3$ to bias the gear $G_3$ in a clockwise direction. A biasing force of the spring $S_6$ is so selected to be sufficiently smaller than a rotating force by which the gear CG meshed with the gear $G_1$ is rotated in the direction $A_3$. With this arrangement, when the rod R is disengaged from the cam $C_4$ by rotating in the clockwise direction around the pivot center Rc by the urging force of the cam $C_3$ after the electromagnet E is energized, the sheet supply roller 117 tries to rotate in the direction $A_3$ with the greater acceleration by pushing the cam $C_1$ by the spring forces of the springs $S_2$, $S_3$ via the roller 115. In this case, the gear CG having the cut-out portion also tries to rotate in the direction $A_3$ suddenly. However, since the gear $G_3$ is biased toward the clockwise direction, it is possible to reduce the shock generated when the gear CG is engaged by the gear $G_1$.

Accordingly, it is possible to reduce the rotation fluctuation of the convey means (driven by the same drive source), thereby maintaining the stable sheet conveying operation. Further, in this embodiment, since the acceleration is reduced by the engagement between the gears, the rate of the reduction of the acceleration of the sheet supply roller 117 can be adjusted more easily than the first embodiment.

Incidentally, the convey means driven by the same drive source as the sheet supply roller 117 is not limited to the regist rollers 105*a*, 105*b* shown in this embodiment, but may include conventional pair of convey rollers. Further, in a case where the sheet supply portion is driven by a motor which also drives the photosensitive drum 107*a*, by applying the present invention, it is possible to prevent the dispersion of the rotational speed of the photosensitive drum 107*a*, thereby permitting the uniform image formation.

Further, the aforementioned process cartridge 107 includes an electrophotographic photosensitive body as an image bearing member, and at least one process means. Accordingly, the process cartridge may incorporate therein an image bearing member and a charger means as a unit which can be removably mounted to an image forming apparatus, or may incorporate therein an image bearing member and a developing means as a unit which can be removably mounted to an image forming apparatus, or may incorporate therein an image bearing member and a cleaning means as a unit which can be removably mounted to an image forming apparatus, or may incorporate therein an image bearing member and two or more process means as a unit which can be removably mounted to an image forming apparatus, as well as the above-mentioned one.

Further, in the above-mentioned embodiment, while the laser beam printer was shown as the image forming apparatus, the present invention is not limited to the laser beam printer, but may be applied to other image forming apparatuses such as a copying machine.

As mentioned above, according to the aforementioned embodiments, since the transmission of the driving force is controlled moderately by regulating the sheet supplying operation of the sheet supply means with the force weaker than the lifting force for the sheet stacking means by means of the control means when the driving force is transmitted to the sheet supply means by lifting the sheet stacking means by the lifting/lowering means synchronizes with the driving force transmitting operation of the driving force transmitting means, it is possible to make the sheet conveying operation of the convey means driven by the same drive means stable.

Next, an embodiment wherein the present invention is applied to an ink jet printer will be explained.

Figure 7:
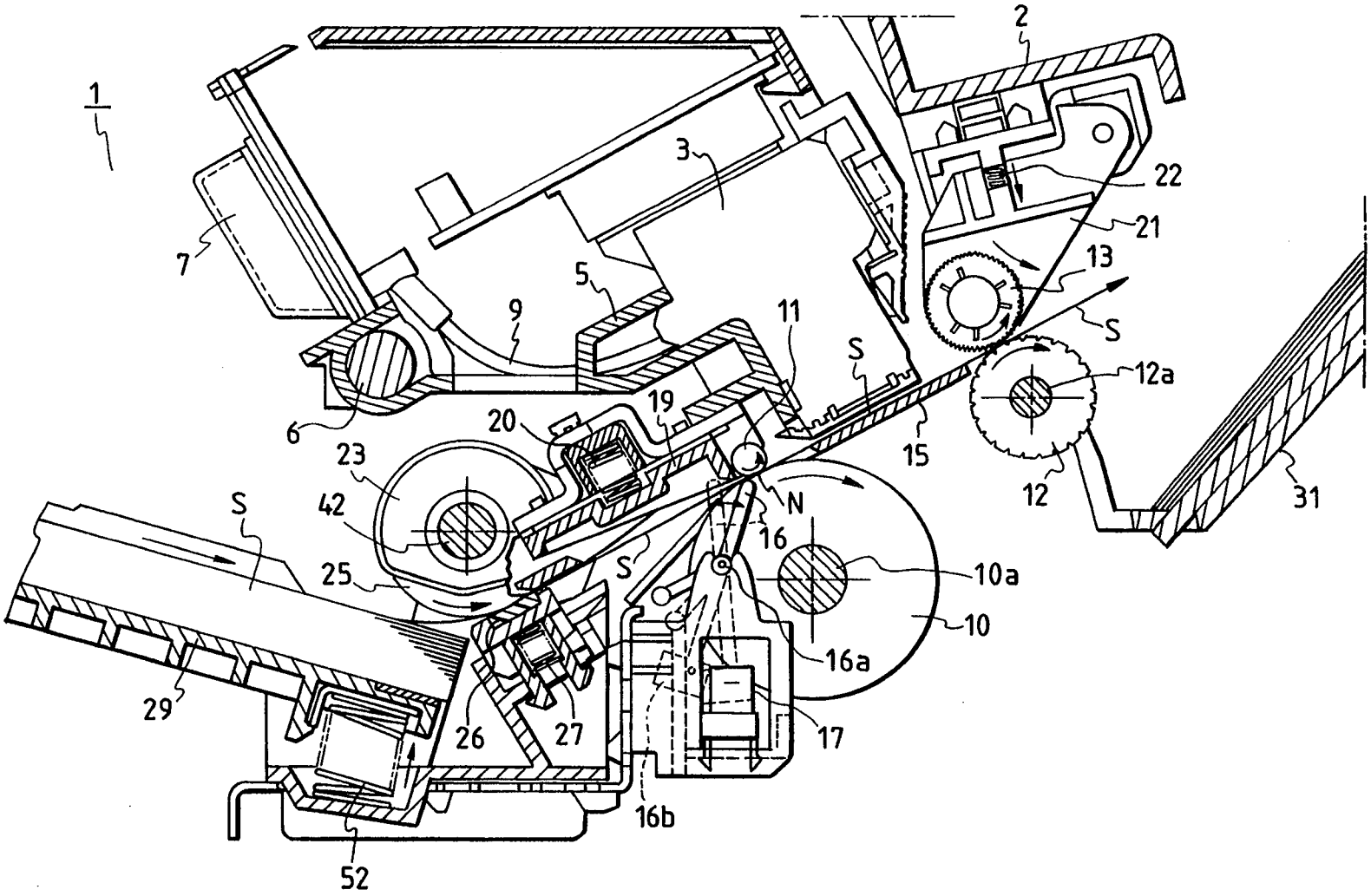
FIG. 7 is an elevational sectional view of an ink jet printer having the apparatus of FIG. 4.

FIG. 7 shows an example of a recording apparatus of a so-called serial type in which the recording is effected by scanning a recording means and a sheet in a main scan direction and a sub scan direction, respectively, as a sectional view looked at from the main scan direction.

In FIG. 7, the reference numeral 3 denotes an ink jet recording head as a recording means; 5 denotes a carriage on which the ink jet recording head is mounted and which shifts in the main scan direction; 6 denotes a carriage along which the carriage is shifted; 7 denotes an ink tank containing ink which is discharged from the ink jet recording head 3; 9 denotes an ink pipe through which the ink is supplied from the ink tank 7 to the ink jet recording head 3; 10 denotes a convey roller for holding the sheet S and for conveying the sheet in the sub scan direction; 11 denotes a driven roller for urging the sheet S against the convey roller 10 to generate a conveying force; 12 denotes a discharge roller for discharging the sheet S from a recording position; and 13 denotes a driven roller for urging the sheet S against the discharge roller 12 to generate a conveying force.

The reference numeral 15 denotes a paper guide disposed between the convey roller 10 and the discharge roller 12 and for defining the recording position where an image is recorded on the sheet S by the ink jet recording head 3; 16 denotes a sensor lever disposed at an upstream side of a nip between the convey roller 10 and the driven roller 11 in the sheet feeding direction and for detecting a leading end and a trailing end of the sheet S; 17 denotes a photo-sensor for converting the movement of the sensor lever 16 into an electric signal; 19 denotes a holder member for holding the driven roller 11; 20 denotes a spring for biasing the holder member 19 to urge the driven roller 11 against the convey roller 10; 21 denotes a holder member for holding the driven roller 13; and 22 denotes a spring for biasing the holder member 21 to urge the driven roller 13 against the discharge roller 12.

The reference numeral 23 denotes a semi-circular sheet supply roller for picking up the sheet S on a sheet supply stacker during the sheet supplying operation; 25 denotes an idle roller arranged in coaxial with the sheet supply roller 23 and having a diameter smaller than a diameter of the sheet supply roller 25; 26 denotes a friction member urged against the sheet supply roller 25 during the sheet supplying operation; 27 denotes a spring for biasing the friction member 26; 29 denotes a sheet stacking plate on which the sheets S are stacked; 31 denotes a sheet discharge stacker on which the sheets (after recording) S are collected; and 52 denotes a leaf spring for urging the sheet stacking plate 29 against the sheet supply roller 23 during the sheet supplying operation.

Figure 8:
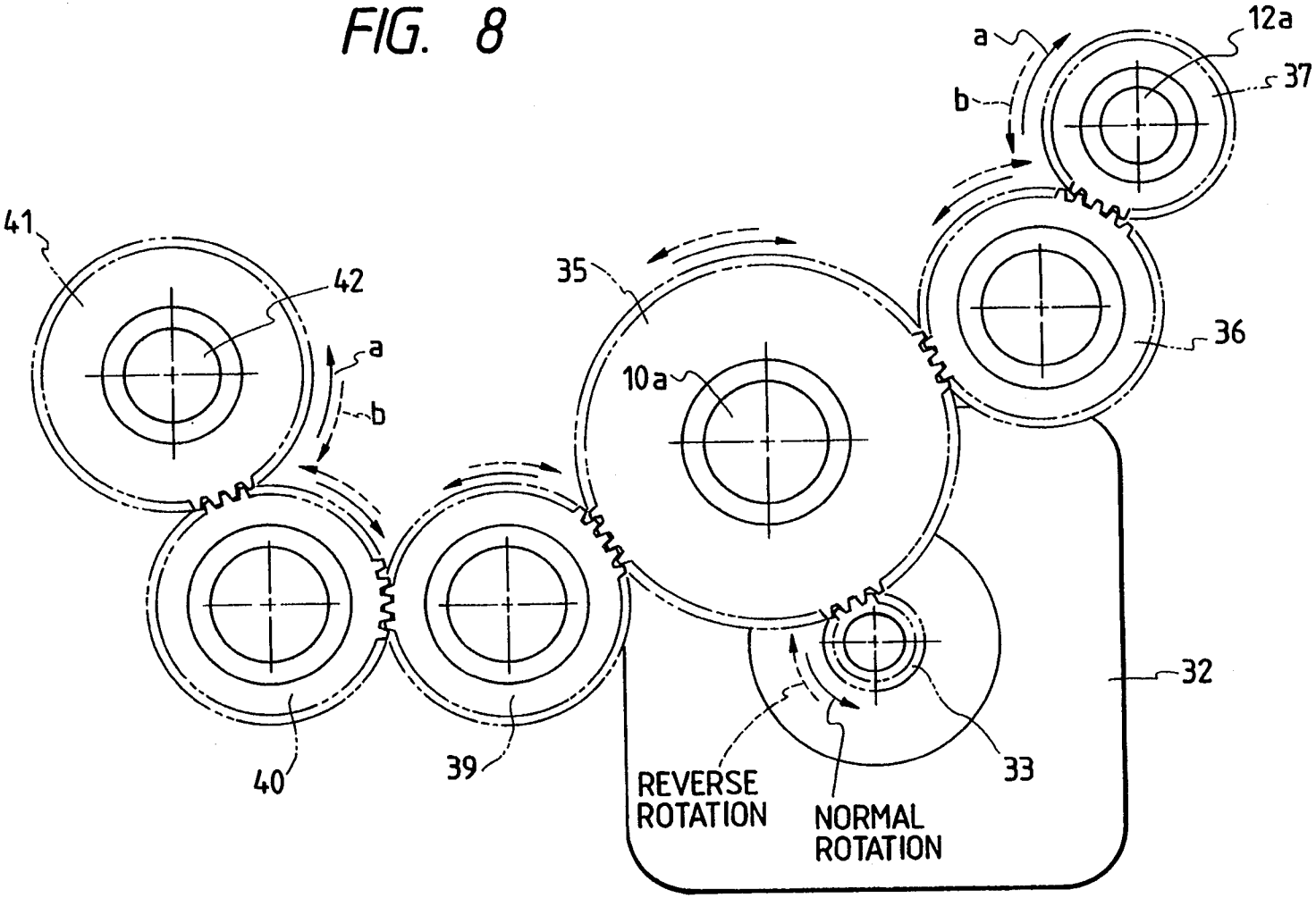
FIG. 8 is an elevational view of a drive mechanism of a sub-scan portion of the printer of FIG. 7.

An example of a drive mechanism for the convey roller 10, discharge roller 12 and sheet supply roller 23 is shown in FIG. 8. In FIG. 8, the reference numeral 32 denotes a sub scan drive motor comprising a pulse motor; 33 denotes a motor gear secured to a motor shaft of the sub scan drive motor 32; 35 denotes a convey roller gear secured to a roller shaft of the convey roller 10; 36, 39 and 40 denote idle gears; 37 denotes a discharge roller gear secured to a roller shaft of the discharge roller 12; and 41 denotes a sheet supply roller gear mounted on a roller shaft of the sheet supply roller 23.

Figure 9:
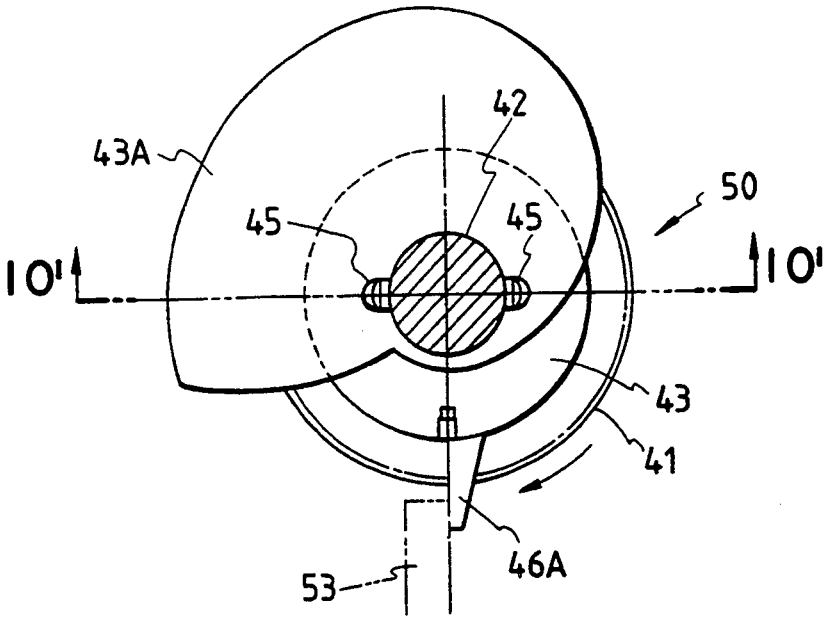
FIG. 9 is a side view of a spring clutch applied to a sheet supply portion of the printer of FIG. 7.
Figure 10:
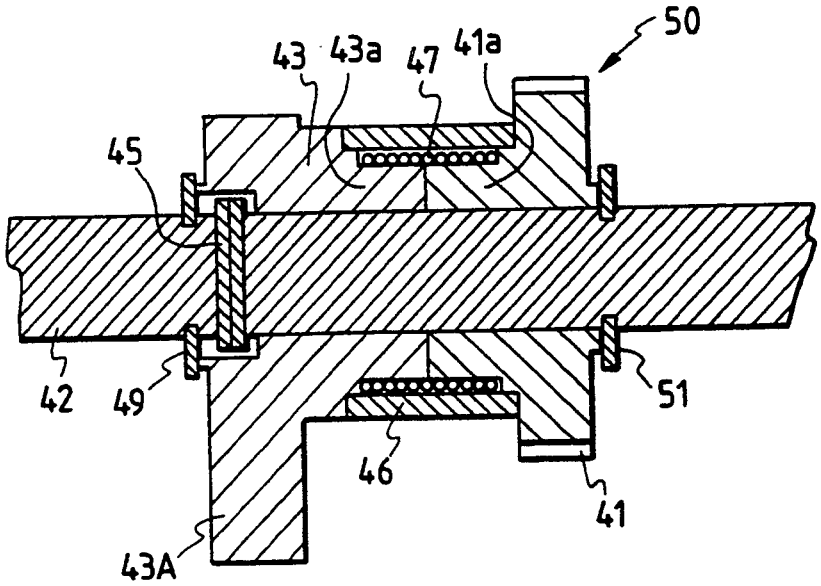
FIG. 10 is a longitudinal sectional view of the spring clutch of FIG. 9.

In many cases, the transmission of the driving force to the sheet supply roller 23 is effected by using a spring clutch so that the sheet supply roller is selectively rotated in a normal direction during the sheet supplying operation. Such spring clutch is shown in FIGS. 9 and 10. Incidentally, FIG. 9 is an end view of the spring clutch, and FIG. 10 is a sectional view taken along the line 10'—10' in FIG. 9. The reference numeral 42 denotes the roller shaft of the sheet supply roller 23; 43 denotes a drum clutch having a cam 43A for controlling the operation of the sheet stacking plate 29 and adapted to transmit the driving force to the roller shaft 42; 45 denotes a pin for preventing the idle rotation of the clutch drum; 46 denotes a control ring having a lever 46A for controlling ON/OFF of the clutch; 47 denotes a coil clutch spring mounted on both a barrel portion 43*a* of the clutch drum 43 and a barrel portion 41*a* of the sheet supply roller gear 41; and 49 and 51 denote pins for preventing a clutch unit 50 from shifting on the roller shaft 42.

The sheet supply roller gear 41 is not secured to the roller shaft 42 of the sheet supply roller. The clutch spring 47 has one end engaged by the clutch drum 43 and the other end engaged by the control ring 46. Other than the sheet supplying operation, the lever 46A of the control ring 46 is held by a ratch member 53, with the result that the clutch spring 47 is loosened, thereby permitting the free rotation of the sheet supply roller gear 41 so that the driving force is not transmitted to the roller shaft 42 of the sheet supply roller.

In the sheet supplying operation, the lever 46A of the control ring 46 is released from the ratch member 53, with the result that the sheet supply roller gear 41 is rotated and the clutch spring 47 is tightened around the barrel portion of the sheet supply roller gear 41, thereby transmitting the driving force to the clutch drum 43 and accordingly the roller shaft 42 of the sheet supply roller to rotate the sheet supply roller 23, thus starting the sheet supplying operation.

Figure 11:
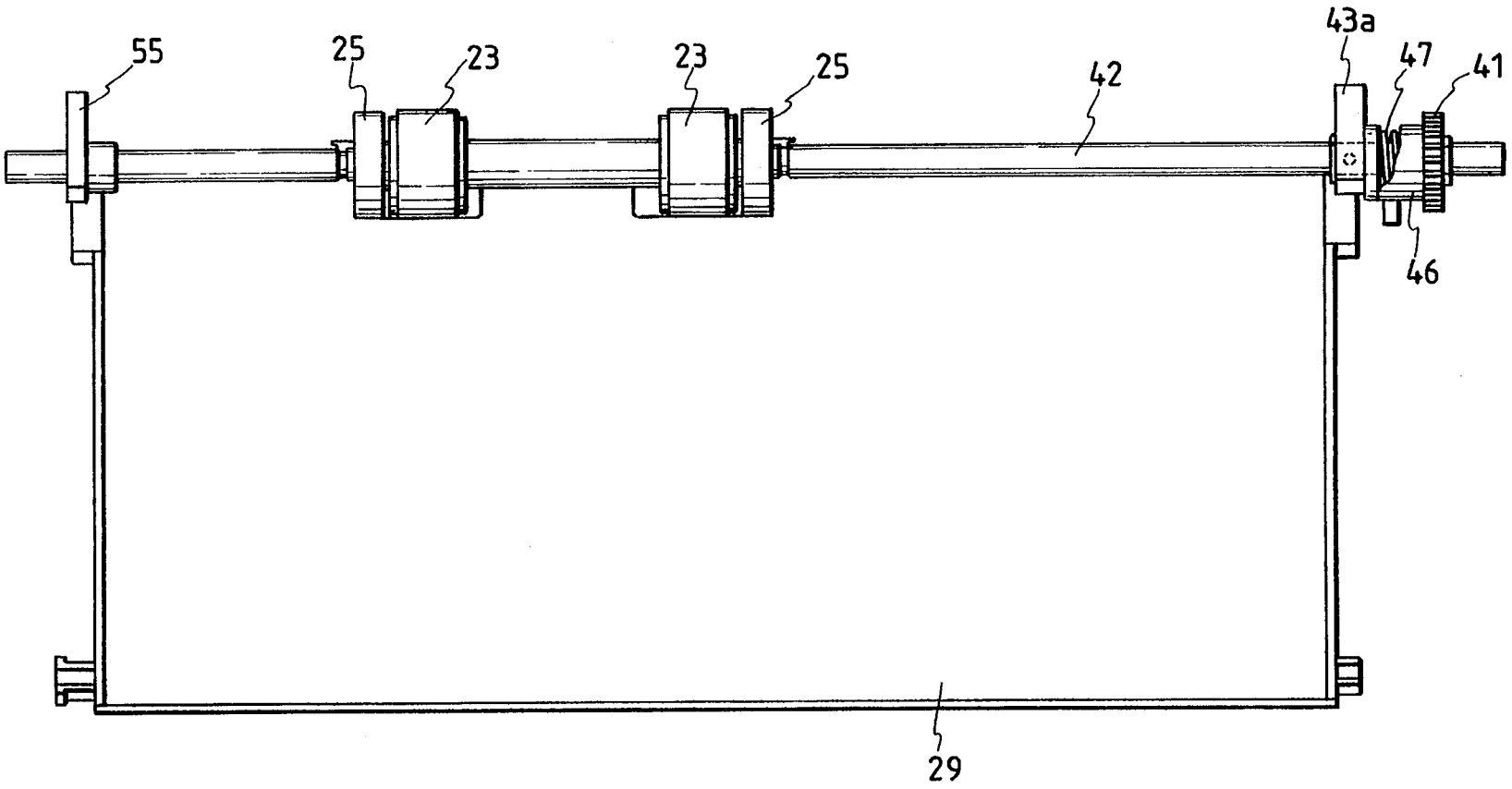
FIG. 11 is a plan view of a sheet supply roller and a sheet stacking plate of the printer of FIG. 7.
Figure 12:
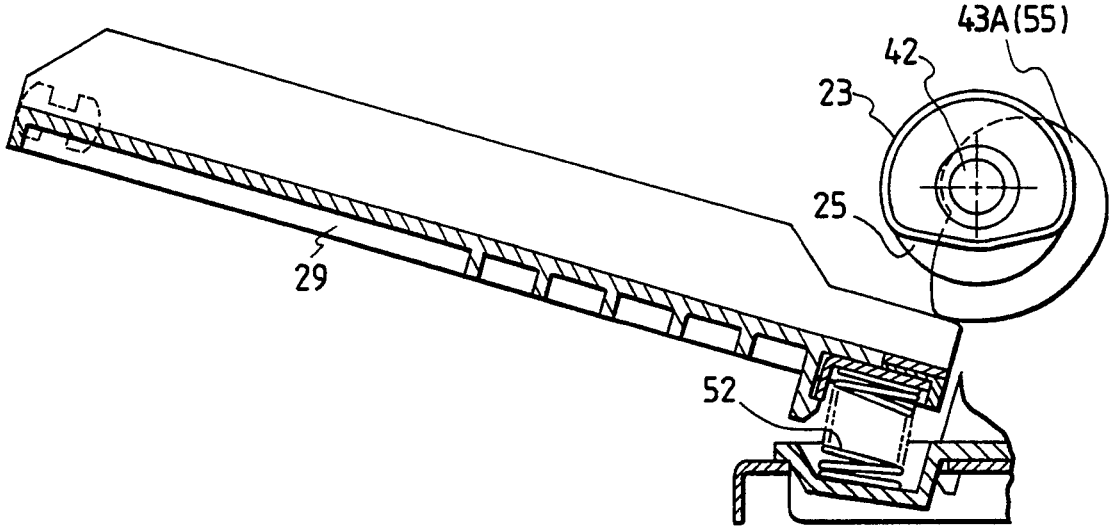
FIG. 12 is a longitudinal sectional view of the sheet supply roller and the sheet stacking plate of FIG. 11.

FIG. 11 is a plan view of the sheet stacking plate 29, sheet supply roller 23 and clutch unit 50. A cam 55 having the same profile as that of the cam 43A of the clutch drum 43 for controlling the operation of the sheet stacking plate 29 is disposed on the roller shaft 42 of the sheet supply roller 23 at an opposite side of the sheet stacking plate 29 regarding the clutch unit 50. FIG. 12 is a cross-sectional view showing the relation between the sheet stacking plate 29, sheet supply roller 23, cam 43A of the clutch drum and the cam 55.

Figure 13:
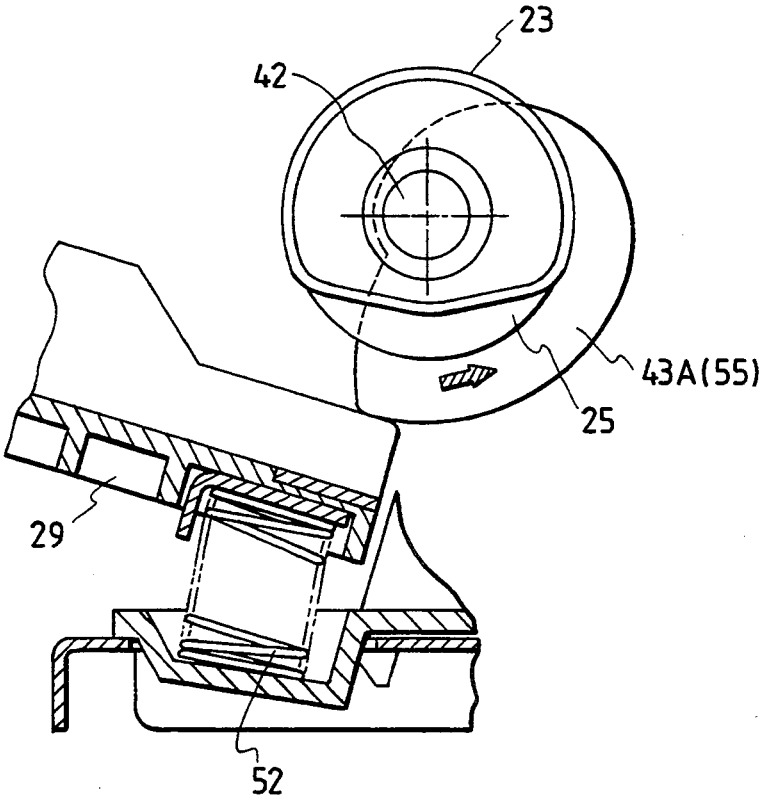
FIGS. 13 to 15 are enlarged sectional views of a main portion of the sheet supply portion of FIG. 7.
Figure 14:
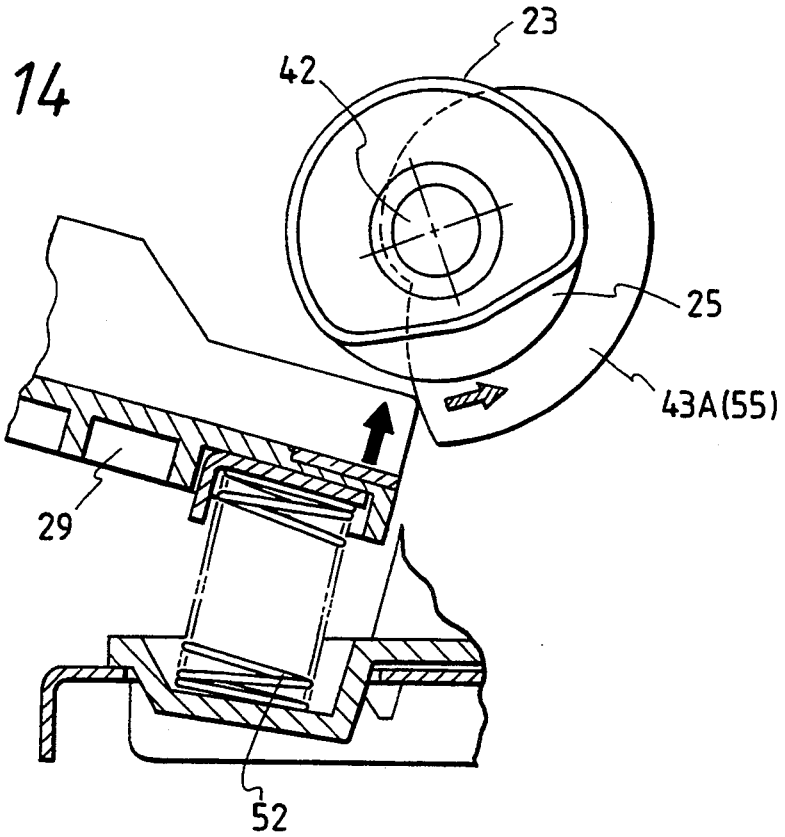
Figure 15:
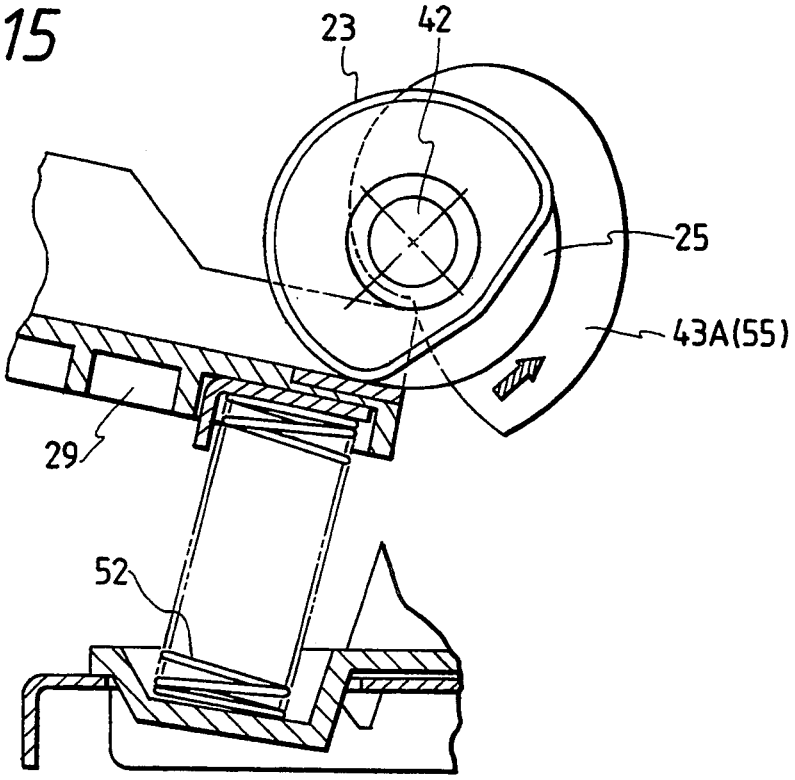

The operations of the sheet stacking plate 29, sheet supply roller 23, cam 43A of the clutch drum and the cam 55 during the sheet supplying operation are shown in FIGS. 13 to 15. In the sheet supplying operation, when the lever 46A of the control ring 46 is released from the ratch member 53, the sheet supply roller gear 41 to which the driving force from the sub scan drive motor 32 is transmitted is rotated and the clutch spring 47 is tightened around the barrel portion of the sheet supply roller gear 41, thereby transmitting the driving force to the clutch drum 43 and accordingly the roller shaft 42 of the sheet supply roller to rotate the sheet supply roller 23, thus starting the sheet supplying operation (FIG. 13). When the cams 43A, 55 are rotated by a small amount, the sheet stacking plate 29 is lifted from the stationary position by the action of the spring 52 in accordance with the profiles of the cams (FIG. 14). The sheet stacking plates 29 continues to lift until the sheet stack S on the sheet stacking plate is abutted against the sheet supply roller 23. Then, the sheets are fed out by the sheet supply roller (FIG. 15).

Figure 4:
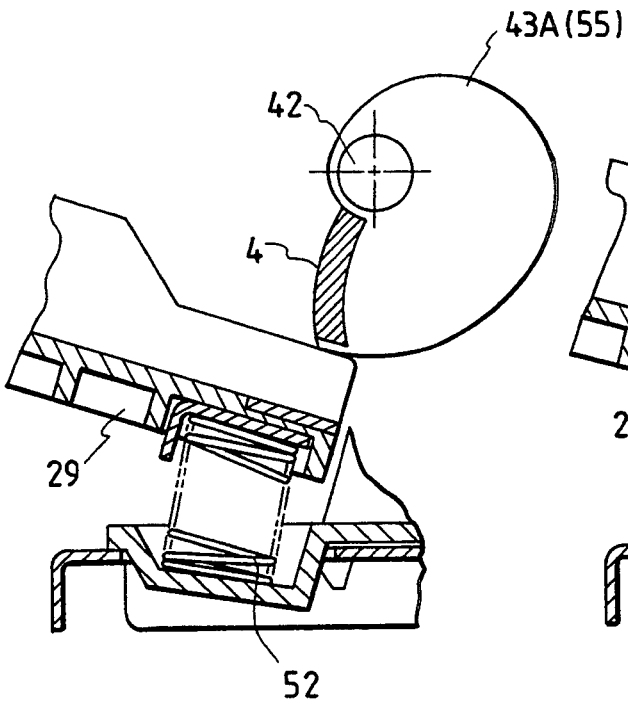
FIG. 4 is a sectional side view of a main portion of a sheet supplying apparatus according to a further embodiment of the present invention.
Figure 5:
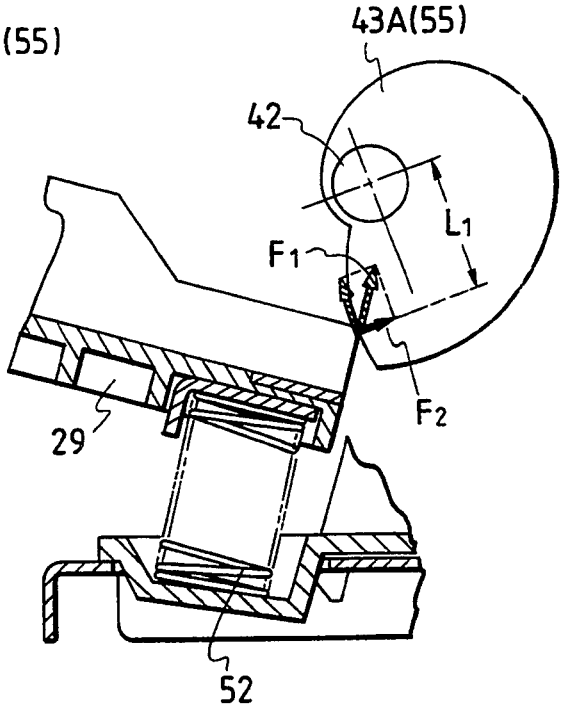
FIGS. 5 and 6 are explanatory views showing a relation of forces in the apparatus of FIG. 4.

As shown in FIG. 4, elastic members 4 such as rubber plates are disposed on surfaces of the cams 43A, 55 to which the sheet stacking plate 29 is abutted when the stacking plate is lifted. When the sheet stacking plate 29 is lifted, the sheet stacking plate urges the abutment surfaces of the cams 43A, 55 with a force of F1 (FIG. 5) with the aid of the spring 52. In this case, the component of force in the rotational direction of the roller shaft 42 of the sheet supply roller becomes F2, and the moment regarding the rotational direction of the roller shaft 42 of the sheet supply roller becomes M1 ($=F2\times L1$).

Figure 6:
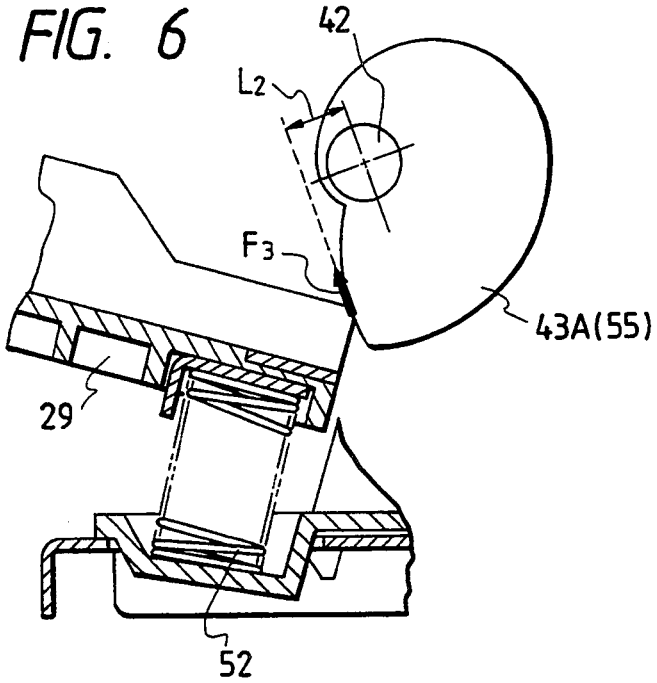

Further, the friction force between the sheet stacking plate 29 and the cams 43A, 55 generated by the force F2 and acting on the cams 43A, 55 becomes F3, and the moment acting toward a direction opposite to the rotational direction of the roller shaft. 42 of the sheet supply roller becomes M2 ($=F3\times L2$) (FIG. 6). Normally, a sliding member such as a cam is made of material having low coefficient of friction to improve the sliding feature of the member. That is to say, the moment M2 is substantially zero, and the moment M1 is not substantially decreased and acts toward the rotational direction of the roller shaft 42 of the sheet supply roller, thus causing the great striking noise.

However, in the illustrated embodiment by providing the elastic members 4 such as rubber plates having high coefficient of friction on the surfaces of the cams 43A, 55 to which the sheet stacking plate 29 is abutted when the latter is lifted, the value of the moment M2 is increased and the moment M1 acting toward the rotational direction of the roller shaft 42 of the sheet supply roller is decreased, thereby preventing the rotation of the roller shaft more than the predetermined number of rotations, whereby, since the sheet stacking plate 29 can be abutted against the idle roller 25 while controlling the lifting speed of the sheet stacking plate 29, the sheet supplying operation is achieved without generating the great striking noise during the lifting movement of the sheet stacking plate 29.

Figure 16:
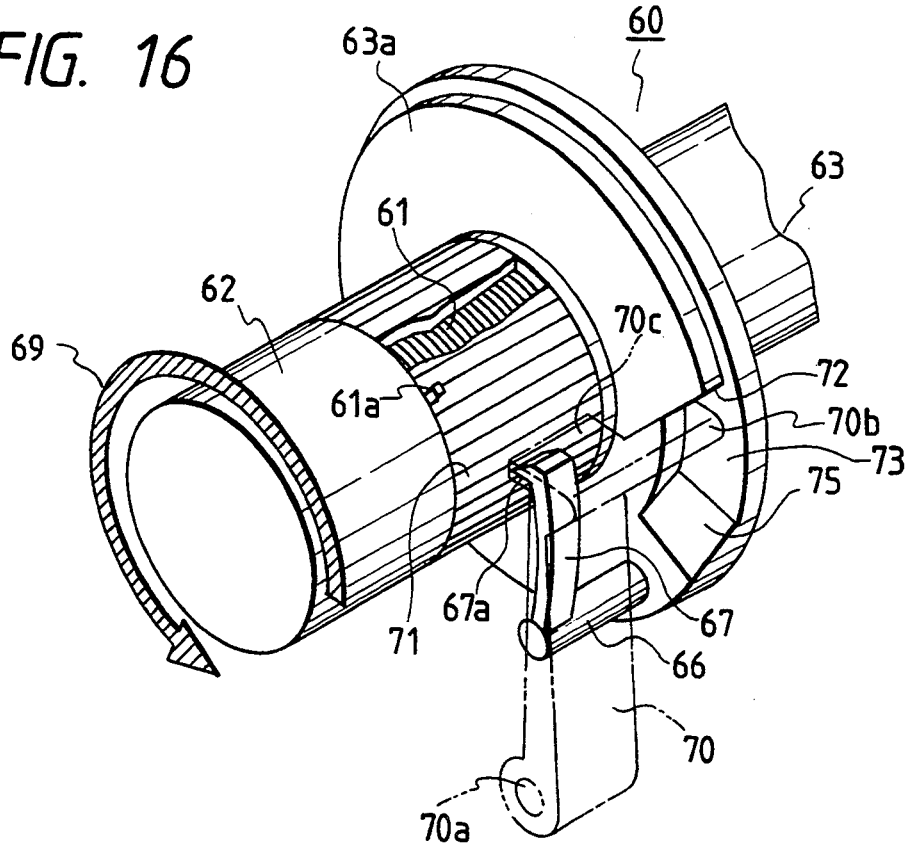
FIG. 16 is a perspective view of a spring clutch according to another embodiment.

Next, a spring clutch according to another embodiment will be explained with reference to FIG. 16. In FIG. 16, the reference numeral 62 denotes a drive shaft; and 61 denotes a clutch spring. In this embodiment, a driven shaft 63 has a flange portion **63*a*. For example, in a sheet supplying apparatus, required members such as sheet supply roller are provided on this driven shaft. The spring clutch 61 is mounted around the drive shaft 62 and the driven shaft 63 with appropriate tightening margin. The clutch spring 61 is mounted on both of the drive shaft 62 and the driven shaft 63. A control ring 71 is mounted around the clutch spring 61. The control ring 71 has a notch into which one end 61*a* of the clutch spring 61 is fitted. Ratchet grooves are formed on the outer surface of the control ring 71, and a pawl 67*a* of a ratch member 67** is engaged by one of ratchet grooves.

The ratch member 67 is integrally formed with the driven shaft 63, and the pawl **67*a* can be deflected with respect to the control ring 71. Further, a stopper member 70 is pivotally mounted on a support shaft (not shown) supported by a frame by which the drive shaft 62 and the driven shaft 63 are supported, and the stopper member is biased toward the control ring 71 by a biasing means (not shown). At the same time, the stopper member 70 is also biased toward the flange portion of the driven shaft 63 so that a boss portion 70*b*** of the stopper member is abutted against the surface of the flange portion. The biasing means (not shown) may be a torsion coil spring.

Figure 17:
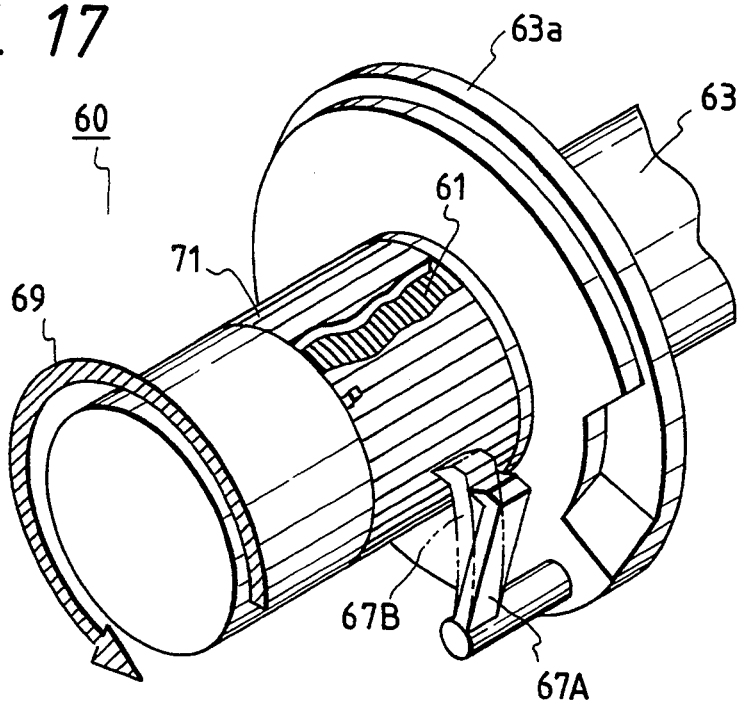
FIG. 17 is a perspective view showing an operation of the spring clutch of FIG. 16.

FIG. 17 shows a condition that the ratch member 67 integrally formed with the driven shaft 63 is deflected. In a non-loaded condition, the ratch member 67 is in a position shown by 67A where the pawl **67*a* of the ratch member is disengaged from the ratchet grooves of the control ring 71. In this unratched condition, the rotation of the drive shaft 62 is transmitted to the driven shaft 63 by the clutch spring 61, thereby rotating the driven shaft 63. The driven shaft 63 is rotated in the normal direction, with the result that the ratch member 67 is deflected by interfering the ratch member 67 with an arm portion of the stopper member 70, thereby engaging the pawl 67*a* of the ratch member 67 by the ratchet groove of the control ring 71 at a position shown by 67B in FIG. 17**.

The force for biasing the stopper member 70 toward the control ring 71 must be strong sufficient to deflect the ratch member 67. In this condition, the ratch member 67 integrally formed with the driven shaft 63 is rotated normally to abut against the stopper member 70. Immediately after the ratch member is abutted against the stopper member, the spring clutch is loosened, thereby preventing the transmission of the driving force through the spring clutch. That is to say, the driven shaft 63 is stopped by the stopper member 70.

Figure 18A:
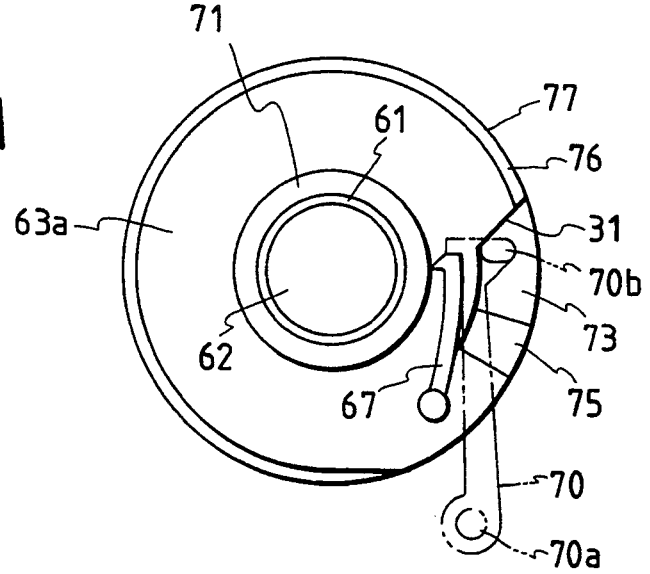
FIGS. 18A to 18C are end views showing an operation of the spring clutch of FIG. 16.
Figure 18B:
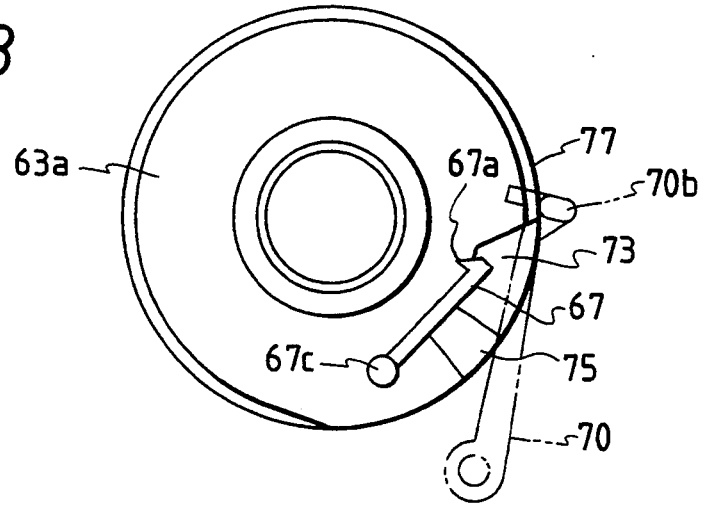
Figure 18C:
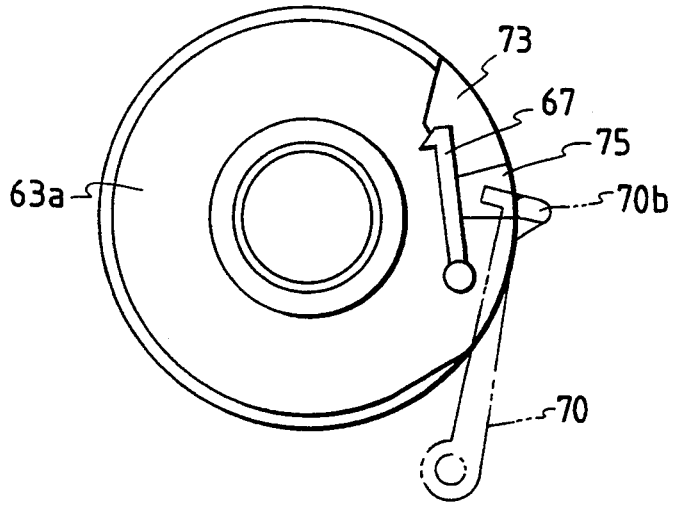

FIGS. 18A to 18C are end views showing such movement. Next, ON/OFF control for the spring clutch 60 will be explained with reference to FIGS. 18A to 18C.

FIG. 18A shows an initial condition where the pawl 67*a* of the ratch member 67 is engaged by the ratchet groove of the control ring 71. As mentioned above, the ratch member 67 is deflected by the arm portion of the stopper member 70. The boss portion 70*b* of the stopper member 70 is abutted against the surface 73 of the flange portion of the driven shaft 63. When the drive shaft 62 is rotated reversely, the driven shaft 63 is rotated reversely by the loosening torque of the clutch spring 61, with the result that the boss portion 70*b* of the stopper member 70 is shifted along an inclined surface 31, thereby rotating the stopper member in the clockwise direction around a pivot center 70*a*.

The stopper member 70 is biased toward the anticlockwise direction and toward the downward direction by a biasing means (not shown) so that the boss portion 70*b* is shifted along an outermost surface 77 of the flange portion of the driven shaft 63. This condition is shown in FIG. 18B. In this case, the ratch member 67 is disengaged from the stopper member 70, with the result that the deflection of the ratch member is released to return the ratch member to its original state, thus unratching the ratch member from the control ring 71.

In this condition, when the drive shaft 62 is rotated normally, since the boss portion 70*b* of the stopper member 70 is positioned along the outermost surface 77 of the flange, the ratch member 67 integrally formed with the driven shaft 63 can be shafted without interference with the stopper member 70. The stopper member 70 is lifted vertically upwardly by an inclined surface 75 (FIG. 18C), so that the boss portion 70*b* is abutted against a side surface of a control cam portion 63*a*. In this condition, the driven shaft 63 is rotated by one revolution, with the result that the stopper member is shifted toward the control ring 71 along the surface 31, thereby setting the stopper member to a position where the ratch member 67 can be stopped again.

In this way, the ON/OFF of the drive is effected. Now, the important matter is a position of the driven shaft 63 in the rotational direction. According to the illustrated embodiment, since the ratch member 67 is integrally formed with the driven shaft 63 and the ratch member 67 is ratched against the control ring 71 by the external stopper member 70 and the ratch member 67 itself is stopped by the stopper member 70, when the positional relation between the various configurations formed on the driven shaft 63 or various elements attached to the driven shaft and the stopper member 70 and the ratch member 67 is maintained with high accuracy, the rotational position of the driven shaft 63 can be obtained with high accuracy.

The positional relation between the various configurations formed on the driven shaft 63 or various elements attached to the driven shaft and the stopper member 70 and the ratch member 67 depends upon the manufacturing accuracy of the parts which can be easily attained, thus not increasing the manufacturing cost. Accordingly, unlike the conventional spring clutch transmitting device, since the inner diameter of the clutch spring and the outer diameters of the barrel portions are not required to manufacture with high accuracy, it is possible to reduce the manufacturing cost greatly. Further, although the desired positional accuracy could not be obtained even when the labor and time were consumed considerably in the conventional device, the desired positional accuracy can easily be achieved according to the illustrated embodiment.

Figure 19:
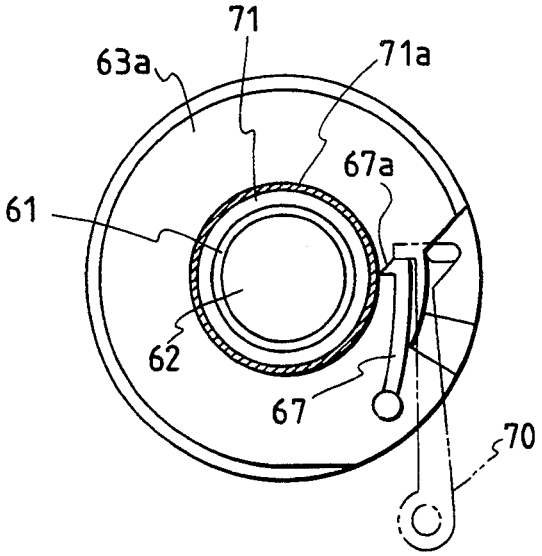
FIG. 19 is a cross-sectional view of a spring clutch according to a further embodiment.

FIG. 19 shows a spring clutch according to a further embodiment. In this embodiment, an elastic body such as rubber sleeve is mounted around the control ring 71. With this arrangement, the pawl 67*a* of the ratch member 67 is penetrated into the elastic body 71*a* when the control ring 71 tries to rotate normally, thereby preventing the normal rotation of the control ring 71. That is to say, the effect of the ratchet grooves according to the aforementioned embodiment is achieved by penetrating the pawl 67*a* of the ratch member 67 into the elastic body 71*a*.

With this arrangement, it is possible to completely eliminate the possible noise generated in the ratchet mechanism. Further, it is possible to stop the control ring at finer positions than the ratchet mechanism, and, thus, it is possible to ratch the control ring at any position completely, thereby setting the position of the driven shaft 63 with higher accuracy.

Figure 20A:
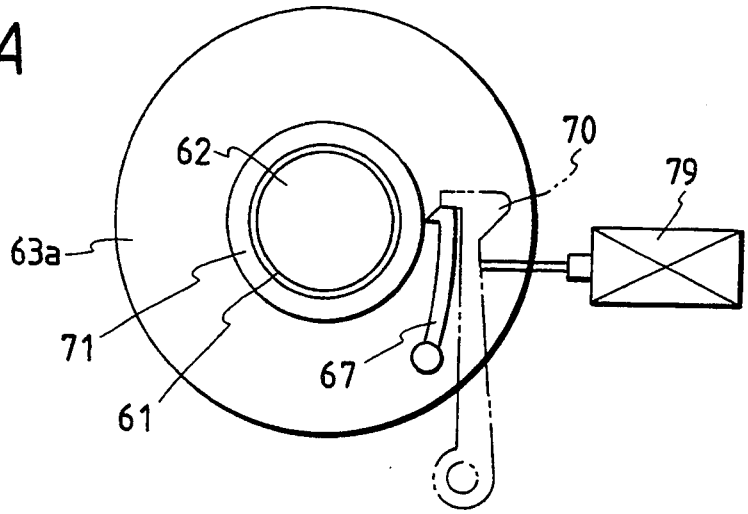
FIGS. 20A to 20C are end views showing an operation of a spring clutch according to a still further embodiment.
Figure 20B:
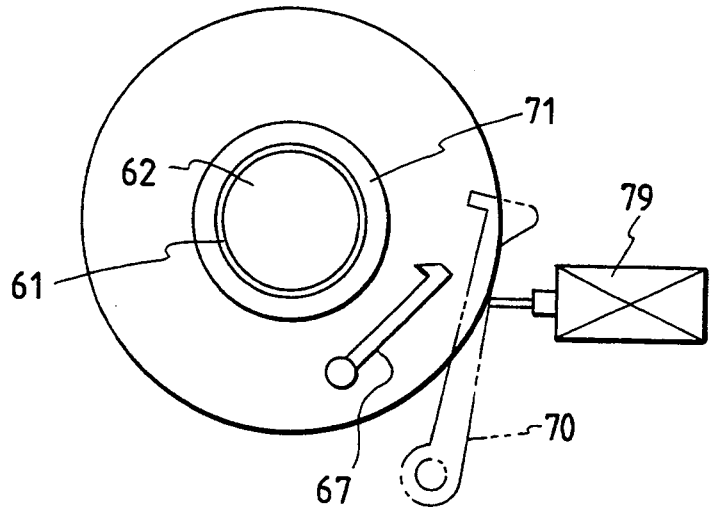
Figure 20C:
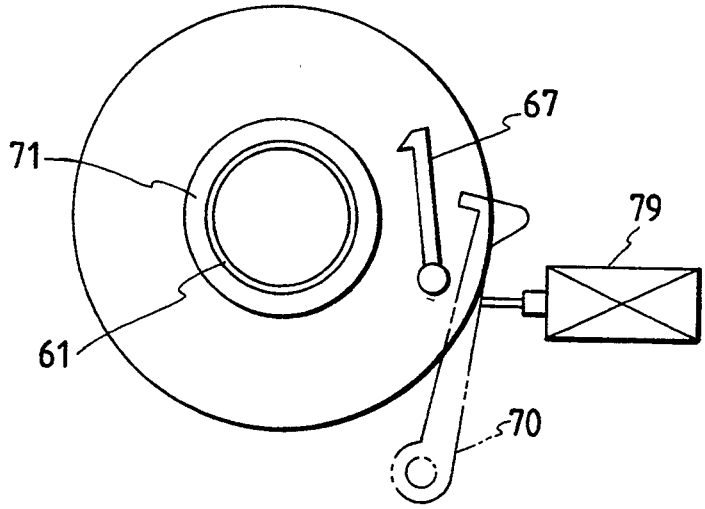

FIGS. 20A to 20C show a spring clutch according to a still further embodiment. In this embodiment, the releasing trigger of the ratch member is effected by a plunger, unlike to the aforementioned embodiments. In the aforementioned embodiments, while the ratch member was released by utilizing the reverse rotation, in this case, if the driven shaft was subjected to the load greater than the loosening torque of the spring clutch, the releasing trigger was not generated. However, in this embodiment, since the releasing trigger is given by the external plunger and the like positively, the above-mentioned disadvantage can be avoided.

In FIG. 20A, the ratch member 67 is ratched against the control ring 71. A plunger 79 has a free end connected to the stopper member 70. When the plunger is energized to attract the stopper member 70, the ratch member 67 is released from the control ring 71. In this way, the ratch effect is released, and the rotation of the drive shaft 62 is transmitted to the driven shaft 63 through the clutch spring 61. The plunger 79 is kept in the ON condition until the free end of the ratch member 67 passes through the stopper portion of the stopper member 70 (FIGS. 20B and 20C).

Thereafter, the plunger 79 is turned OFF, thereby setting the stopper portion of the stopper member 70 to a position where the ratch member 67 can be stopped again. When the driven shaft 63 is rotated by one revolution, the ratch member 67 is interfered with the stopper member 70 again, thus deflecting the ratch member to ratch the pawl 67*a* of the ratch member against the control ring 71, thereby stopping the driven shaft 63. Also in this embodiment, since the ratch member is ratched against the control ring 71 by the external stopper member 70 and the ratch member 67 itself is stopped by the stopper member 70, it is possible to set the position of the driven shaft 63 with high accuracy.

Further, in the illustrated embodiment, it should be noted that the ratch releasing trigger is not limited to the plunger 79. For example, when the present invention is applied to a serial printer, the ratch releasing trigger can be obtained by the shifting movement of a carriage on which a recording head is mounted. In this case, it is not required to use a plunger which is relatively expensive, thereby achieving the trigger with a very cheap construction.

In the above-mentioned arrangement, while the ratch member 67 was integrally formed with the driven shaft 63 and the ratch member was ratched against the control ring by using the deflection of the ratch member, the ratch member may be formed independently formed from the driven shaft 63 and mounted on it, and the ratch member may be biased toward the control ring 71 by a torsion coil spring and the like, which can achieve the same advantage.

Further, in the above-mentioned arrangement, while the stopper member could be rotated around the pivot center, the stopper member may be fixed to a frame and the engagement and disengagement of the ratch member 67 with respect to the fixed stopper member may be controlled-by an appropriate means (reverse trigger, or external trigger obtained by the movement of plunger, carriage or the like).

Figure 21:
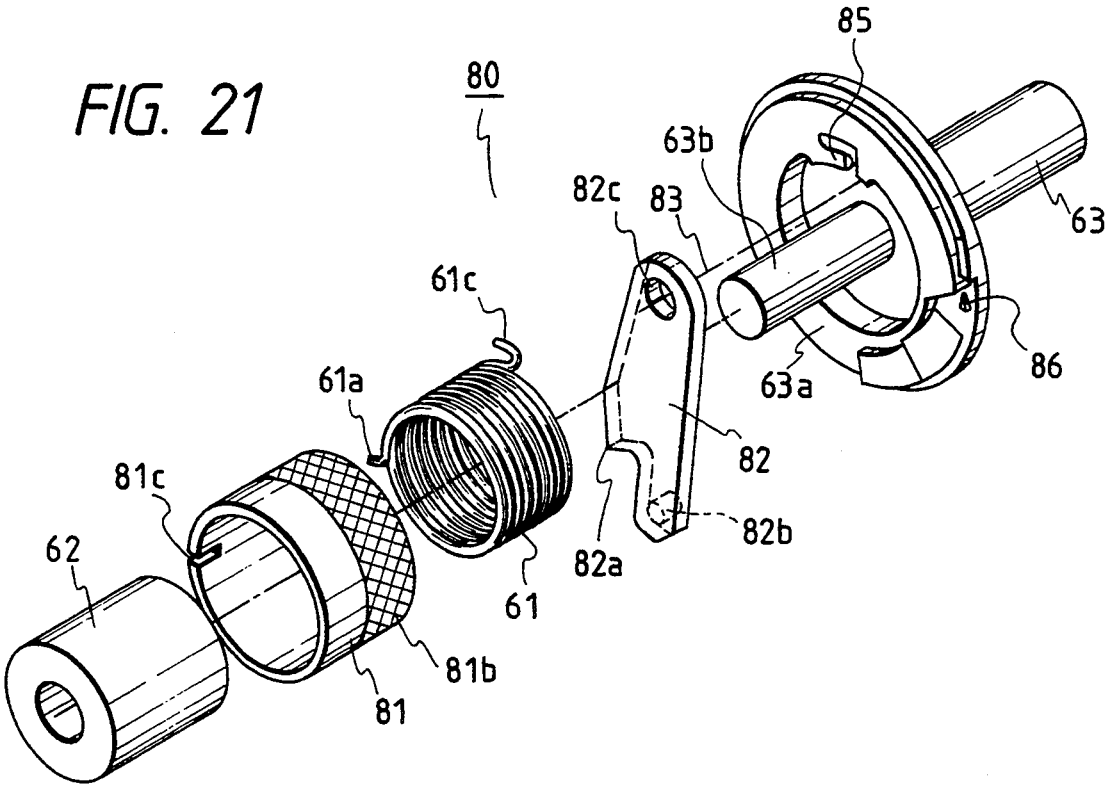
FIG. 21 is an exploded perspective view of a spring clutch according to a further embodiment.

FIG. 21 is an exploded perspective view of a spring clutch according to a further embodiment. In FIG. 21, a clutch spring 61 is mounted around a drive shaft 62 with a predetermined tightening margin. That is to say, the drive shaft 62 also serves as a barrel portion on which the clutch spring 61 is wound, and gears and the like are provided on the drive shaft to transmit the driving force. A control ring 81 is mounted around the clutch spring 61, and one end 61*a* of the clutch spring 61 is fitted into a notch 81*c* formed in the control ring 81. Ratchet teeth are formed on the control ring 81 at zone 81*b* shown by the hatched area.

A driven shaft 63 has a control cam portion 63*a* and a boss portion 63*b*. The boss portion 63*a* is fitted into a central bore of the drive shaft 62. The drive shaft 62, clutch spring 61 and control ring 81 are positioned in coaxial with the driven shaft 63. In this embodiment, the clutch spring 61 is not mounted on both of the drive shaft 62 and the driven shaft 63 as in the aforementioned embodiment, but all of the clutch spring 61 is wound around the driven shaft 62, and the other end 61*c* of the clutch spring 61 is hooked to a hook portion 85 formed on the control cam portion 63*a* of the driven shaft 63. With this arrangement, since there is no interface between the drive shaft 62 and the driven shaft 63 within the clutch spring 61, the clutch spring does not drop between the shafts even if these shafts are deviated from each other.

However, since the driving torque is transmitted only through the hooking engagement between the end 61*c* of the clutch spring and the hook portion of the driven shaft 63, the spring end 61*c* must have the strength sufficient to permit the transmission of the driving torque. Thus, in the illustrated embodiment, the spring end 61*c* is formed as a hook having a U-shaped configuration.

On the other hand, a ratch member 82 is mounted on a frame by which the drive shaft 62 and the driven shaft 63 are supported, by inserting a hole 82*c* of the ratch member onto a boss of the frame. The ratch member can be around the hole 82*c* and is biased by a biasing means such as a torsion coil spring (not shown) so that an edge portion 82*a* of the ratch member is ratched against the ratchet portion 81*b* of the control ring 81. Further, a boss portion 82*b* is formed on a free end of the ratch member 82. The biasing means also biases the boss portion 82*b* toward the cam portion 63*a* of the driven shaft 63, so that the timing for ratching the ratch member 82 against the ratchet portion 81*b* of the control ring 81 is obtained by shifting the boss portion 82*c* on the cam portion 63*a*.

Figure 22A:
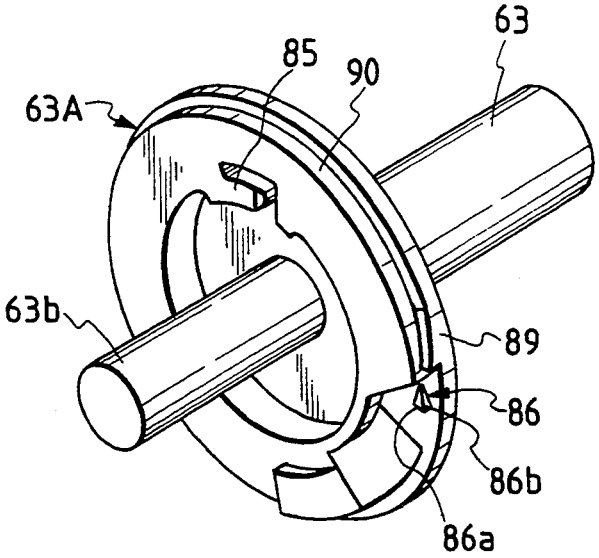
FIGS. 22A and 22B are views showing a driven shaft of the spring clutch of FIG. 21.
Figure 22B:
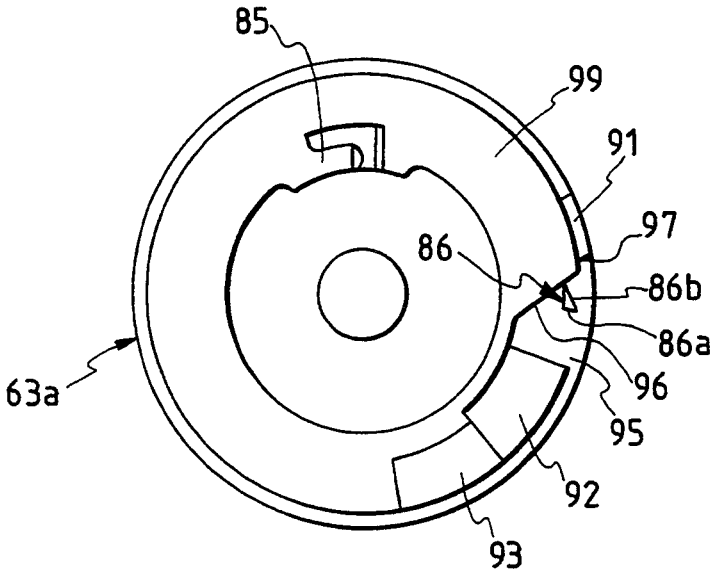

The configuration of the cam portion 63*a* of the driven shaft 63 is shown in FIGS. 22A and 22B in detail. The operation of the illustrated embodiment will be explained with reference to FIGS. 22A and 22B and FIGS. 23A to 25C.

Figure 23A:
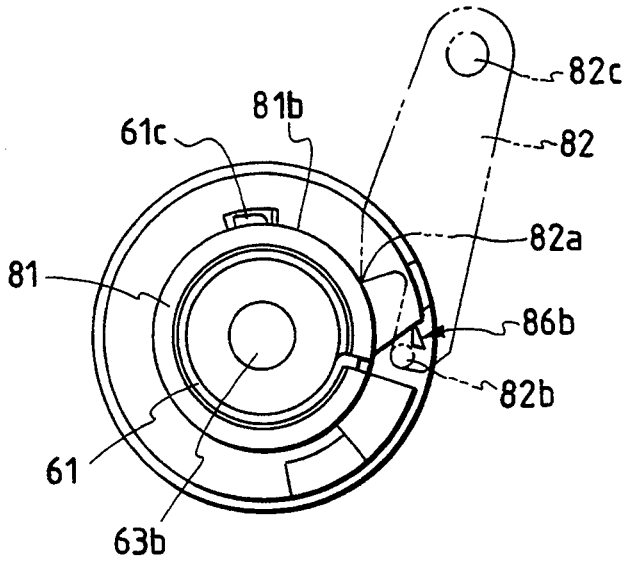
FIGS. 23A to 23C, 24A to 24C and 25A to 25C are end views showing an operation of the spring clutch of FIG. 21.

FIG. 23A shows an initial position of the driven shaft 63. As mentioned above, the ratch member 82 can be pivoted around the hole 82*c* and is biased toward the clockwise direction by the biasing means (not shown). FIG. 23A shows a ratched condition where the edge portion 82*a* of the ratch member 82 is abutted against the ratchet portion 81*b* of the control ring 81. In this case, although the drive shaft 62 is being rotated in an anti-clockwise direction (referred to as "normal direction" hereinafter) shown by the arrow 69*a* or is stopped, in any cases, since the ratch member 82 is ratched against the control ring 81, the clutch spring 61 is in a loosened condition, and, therefore, the driving force is not transmitted to the driven shaft 63.

Figure 23B:
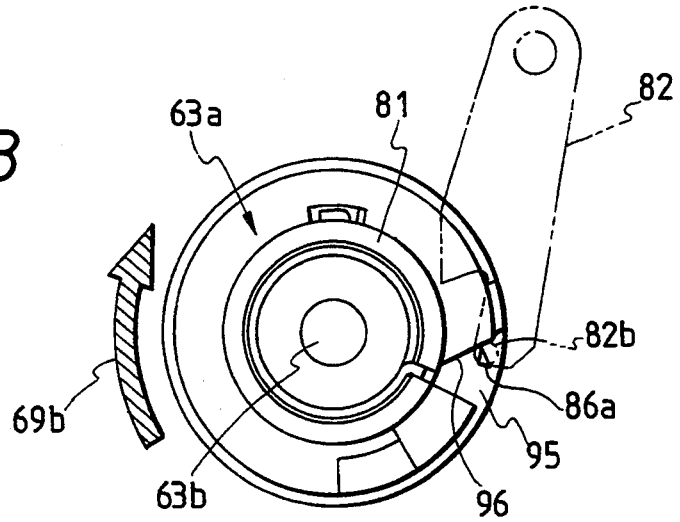
Figure 23C:
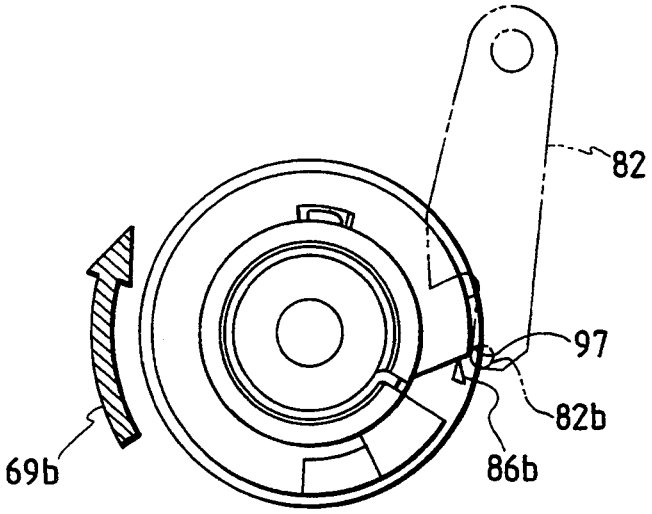
Figure 24A:
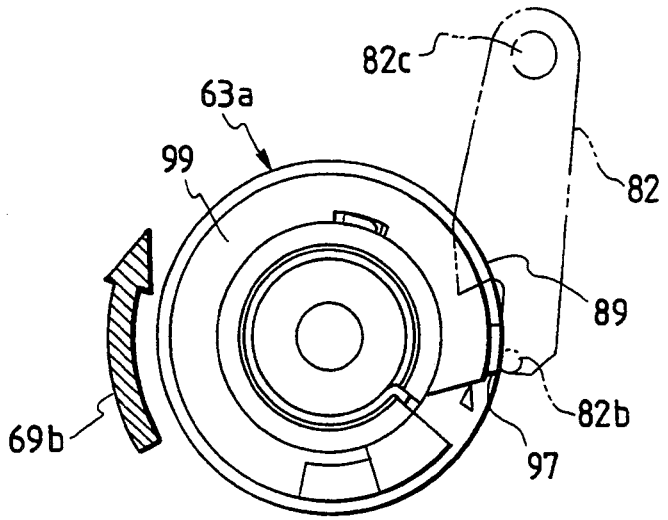

From this condition, when the drive shaft 62 is rotated in a clockwise direction (referred to as "reverse direction" hereinafter) shown by the arrow 69*b* as shown in FIG. 23B, the clutch spring is rotated in the loosened direction, thereby rotating the cam portion 63*a* in the reverse direction by the loosening torque. As a result, the boss portion 82*c* abutted against a surface 95 by the biasing means (not shown) is shifted along an inclined surface 86*a* of a triangular recess 86 and an inclined surface 96, and is then dropped along a wall surface 86*b* of the triangular recess 86, thus abutting against the surface 95 again. When the cam portion 63*a* is further rotated in the reverse direction, as shown in FIG. 23C, the boss portion 82*b* is shifted along a surface 97, and then, as shown in FIG. 24A, the boss portion 82*b* is shifted along an outermost surface 89 of the cam portion. In this case, the back surface of the ratch member 82 is abutted against a surface 99.

Figure 24B:
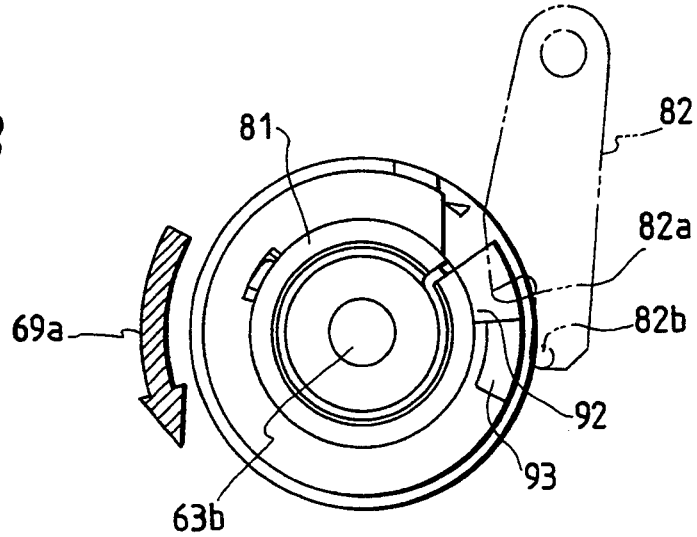
Figure 24C:
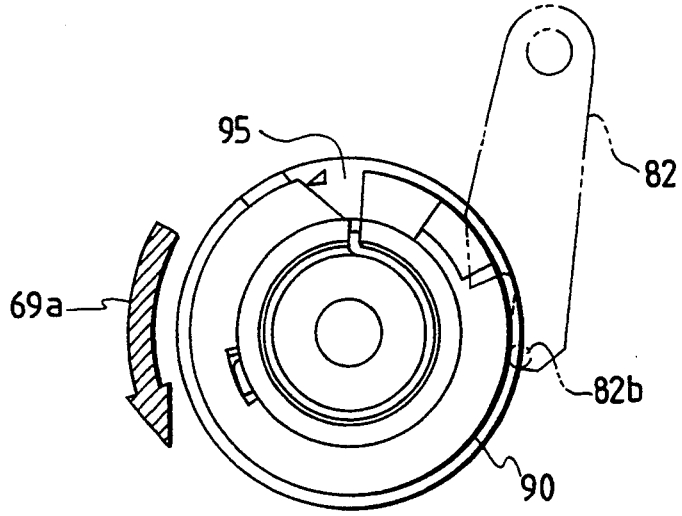

Then, as shown in FIG. 24B, when the drive shaft 62 (FIG. 21) is rotated in the normal direction, since the ratch member 82 is already disengaged from the control ring 81, the rotation of the drive shaft 62 is transmitted to the driven shaft 63 through the clutch spring 61, thus rotating the driven shaft 63 (and the cam portion) in the normal direction. When the drive shaft is further rotated in the normal direction, a portion in the vicinity of the edge portion 82*a* of the ratch member 82 is raised along inclined surfaces 92, 93. The lift amount achieved by these inclined surfaces 92, 93 is selected to be greater than a length of the boss portion 82*b*, and, therefore, the boss portion 82*b* is abutted against the surface 95 again, as shown in FIG. 24C.

Figure 25A:
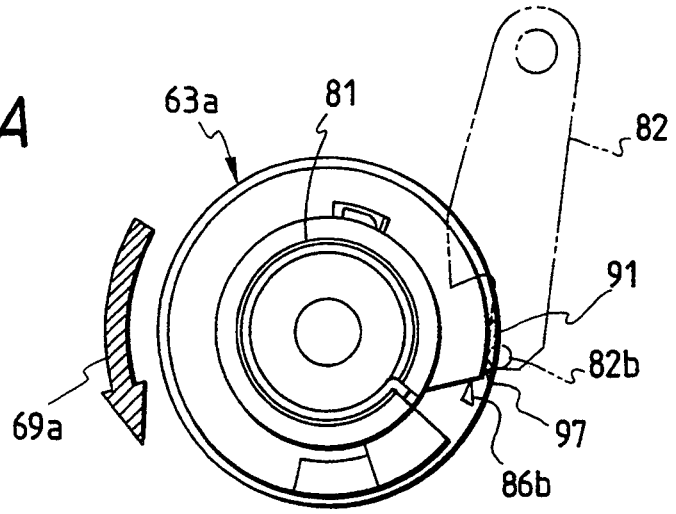
Figure 25B:
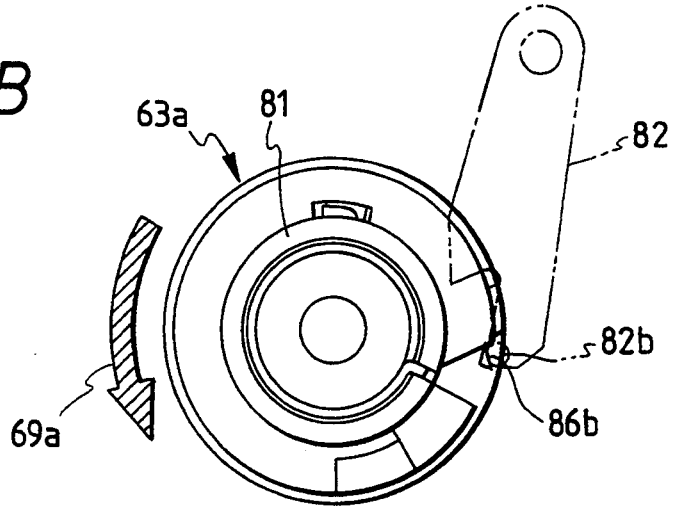
Figure 25C:
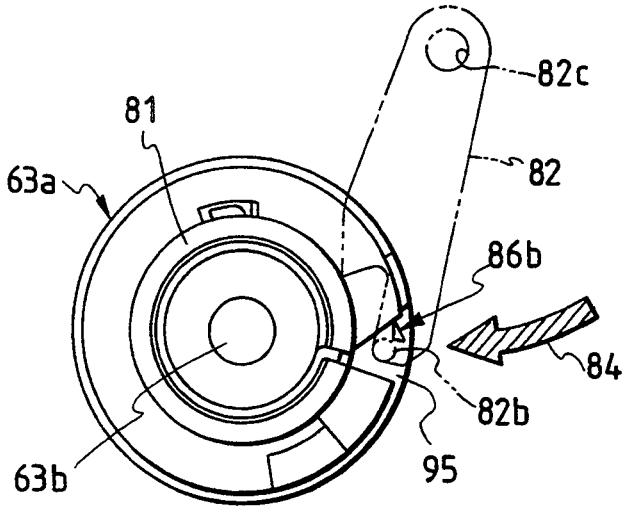

As shown in FIG. 25A, when the cam portion 63*a* is further rotated in the normal direction, the boss portion 82*b* is shifted along a surface 91 and is abutted against the surface 95 via a surface 97. Then, the boss portion 82*b* is shifted along the wall surface 86*b* of the triangular recess 86 (FIG. 25B), and, the boss portion 82*b* is disengaged from the triangular recess 86 as soon as the boss portion leaves the wall surface 86*b*, thereby abutting the ratch member 82 against the control ring 81 to establish the ratching condition between the ratch member and the control ring (FIG. 25C). In this case, the clutch spring 61 becomes the loosened condition, with the result that the transmission of the rotation of the drive shaft 62 to the driven shaft 63 is released, thus stopping the driven shaft 63.

In this way, the ON/OFF control of the drive by the clutch spring 60 is effected. Now, the important matter is a position of the driven shaft 63 in the rotational direction. According to the illustrated embodiment, since the timing for ratching the ratch member 82 against the control ring 81 is obtained by the cam portion 63*a* integrally formed with the driven shaft 63, when the positional relation between the various configurations formed on the driven shaft 63 or various elements attached to the driven shaft and the configuration of the cam portion is maintained with high accuracy, the rotational position of the driven shaft 63 can be obtained with high accuracy.

The positional relation between the various configurations formed on the driven shaft 63 or various elements attached to the driven shaft 63 and the configuration of the cam portion depends upon the manufacturing accuracy of the parts which can easily be attained, thus not increasing the manufacturing cost. Accordingly, unlike to the conventional spring clutch transmitting device, since the inner diameter of the clutch spring and the outer diameters of the barrel portions are not required to manufacture with high accuracy, it is possible to reduce the manufacturing cost greatly.

Further, although the desired positional accuracy could not be obtained even when the labor and time were consumed considerably in the conventional device, the desired positional accuracy can easily be achieved according to the illustrated embodiment.

Incidentally, the triangular recess 86 of the cam portion 63*a* according to the illustrated embodiment is provided to ratch the ratch member 82 against the control ring 81 as faster as possible. That is to say, it is possible to prevent the dispersion in the ratching timing as obtained by gradually approaching the ratch member 82 toward the control ring 81.

Figure 26:
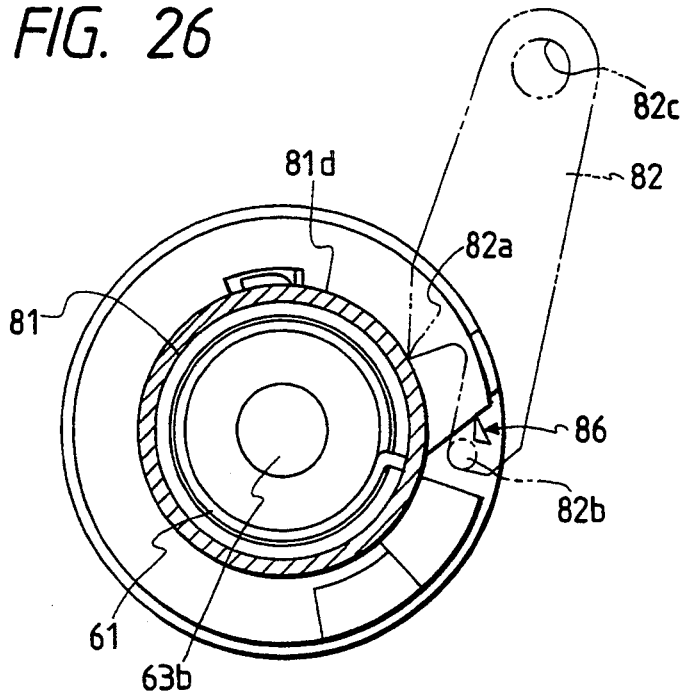
FIG. 26 is a cross-sectional view of a spring clutch according to a further embodiment.
Figure 28:
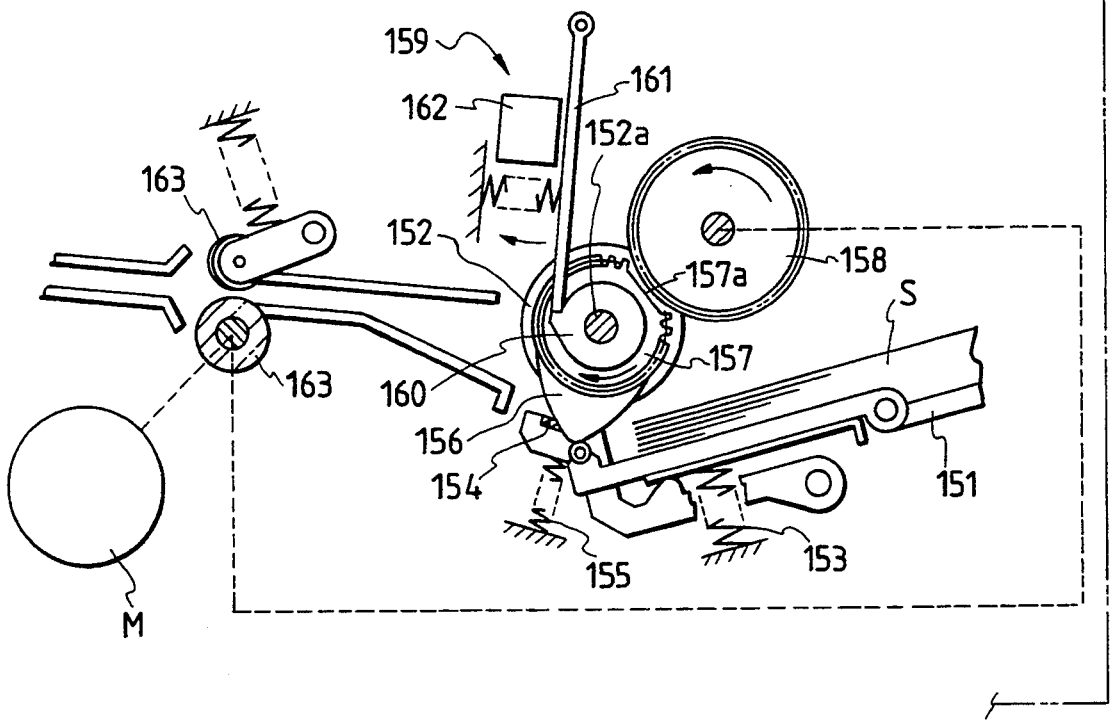
FIG. 28 PRIOR ART
FIG. 28 is a side view of a conventional sheet supplying apparatus.

FIG. 26 shows a spring clutch according to a further embodiment. In this embodiment, an elastic body such as rubber sleeve is mounted around the control ring 81. With this arrangement, the edge portion 82*a* of the ratch member 82 is penetrated into the elastic body 81*d* when the control ring 81 tries to rotate normally, thereby preventing the normal rotation of the control ring 81. That is to say, the effect of the ratchet according to the aforementioned embodiment is achieved by penetrating the edge portion 82*a* of the ratch member 82 into the elastic body 81*d*.

With this arrangement, it is possible to completely eliminate the possible noise generated in the ratchet mechanism. Further, it is possible to stop the control ring at finer positions than the ratchet mechanism, and, thus, it is possible to ratch the control ring at any position completely, thereby setting the position of the driven shaft 63 with higher accuracy.

Figure 27A:
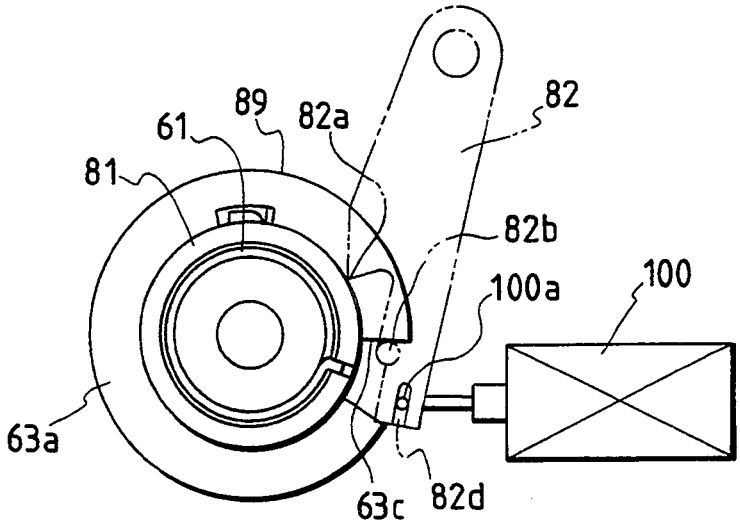
FIGS. 27A to 27C are end views showing an operation of the spring clutch of FIG. 26.
Figure 27B:
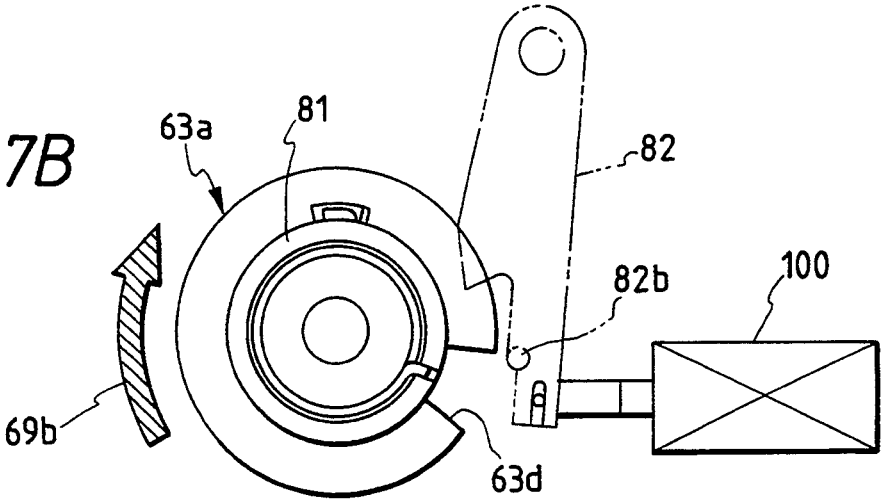
Figure 27C:
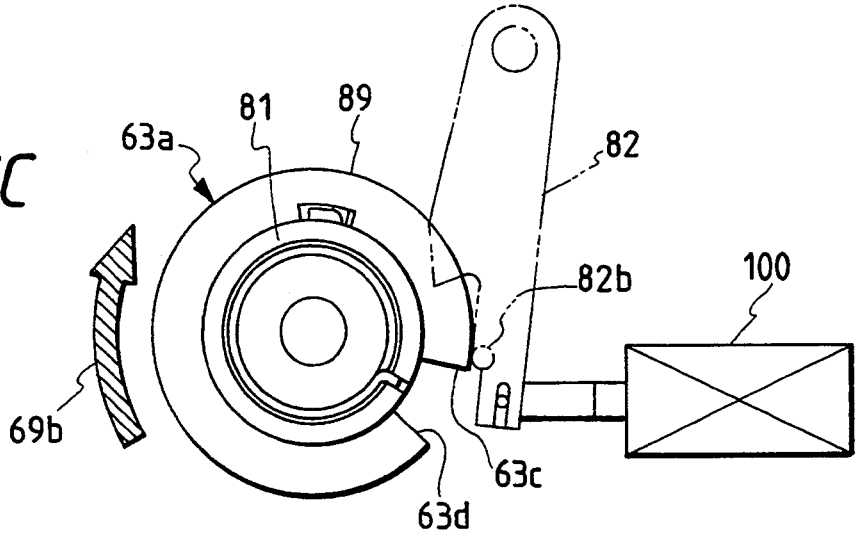

FIGS. 27A to 27C show a spring clutch according to a still further embodiment. In this embodiment, the releasing trigger of the ratch member is effected by a plunger, unlike to the aforementioned embodiments. In the aforementioned embodiments, while the ratch member was released by utilizing the reverse rotation, in this case, if the driven shaft 63 was subjected to the load greater than the loosening torque of the spring clutch 61, the releasing trigger was not generated. However, in this embodiment, since the releasing trigger is given by the external plunger and the like positively, the above-mentioned disadvantage can be avoided.

In FIG. 27A, the ratch member 82 is ratched against the control ring 81. A plunger 100 is provided at its free end with a boss 100*a* which is fitted into a slit 82*d* formed in the ratch member 82. When the plunger 100 is energized to attract the ratch member 82, the boss portion 82*b* of the ratch member 82 is disengaged from a surface 63*c* of the cam portion 63*a* and is shifted on a surface 63*d*. In this way, the ratch effect is released, and the rotation of the drive shaft is transmitted to the driven shaft 63 through the clutch spring 61 (FIG. 27B).

The plunger 100 is kept in the ON condition until cam portion 63*a* is rotated and the surface 63*d* passes through the boss portion 82*b*.

After the surface 63*d* passes through the boss portion 82*b*, the plunger 100 is turned OFF, thereby abutting the boss portion 82*b* against the surface 89 (FIG. 27C). When the driven shaft 63 is rotated by one revolution, the boss portion 82*b* is shifted along the surface 63*c*, thereby ratching the edge portion 82*a* of the ratch member 82 against the control ring 81, thus stopping the driven shaft 63. Also in this embodiment, since the timing for ratching the ratch member 82 against the control ring 81 is obtained by the cam portion, it is possible to set the position of the driven shaft 63 with high accuracy.

Further, in the illustrated embodiment, it should be noted that the ratch releasing trigger is not limited to the plunger. For example, when the present invention is applied to a serial printer, the ratch releasing trigger can be obtained by the shifting movement of a carriage on which a recording head is mounted. In this case, it is not required to use a plunger which is relatively expensive, thereby achieving the trigger with a very cheap construction.

According to the present invention, in a sheet supplying apparatus wherein a sheet is supplied by abutting a sheet stack rested on a sheet stacking plate against a sheet supply roller by lifting the sheet stacking plate by the action of a cam, since the cam acts to reduce the moment acting toward the rotational direction of the sheet supply roller by providing the elastic member having high coefficient of friction on the surface of the cam against which the sheet stacking plate is abutted when the later is lifted, it is possible to prevent the sheet supply roller from rotating more than the predetermined number of rotations, to control the lifting speed of the sheet stacking plate, and, thus, to suppress the striking noise generated when the stacking plate is lifted.

What is claimed is:

1. A sheet supplying apparatus, comprising:

sheet supporting means for supporting a sheet and being shiftable between a supply position and a waiting position;

supply means for feeding out the sheet from said sheet supporting means at said supply position;

biasing means for biasing said sheet supporting means from said waiting position toward said supply position;

shifting means for shifting said sheet supporting means from said supply position to said waiting position in opposition to a biasing force of said biasing means; and regulating means for regulating the shifting of said sheet supporting means with a force weaker than the biasing force of said biasing means, when said sheet supporting means is shifted from said waiting position to said supply position by said biasing means.

2. A sheet supplying apparatus according to claim 1, wherein said regulating means reduces a shifting speed as said sheet supporting means is shifted from said waiting position to said supply position.

3. A sheet supplying apparatus according to claim 1, wherein said biasing means is a coil spring for biasing said sheet supporting means toward said supply position.

4. A sheet supplying apparatus according to claim 1, wherein said shifting means comprises a rotatable cam slidingly contacting with said sheet supporting means, and said sheet supporting means is shifted between said waiting position and said supply position by rotation of said cam.

5. A sheet supplying apparatus according to claim 4, wherein said regulating means comprises a spring for providing a biasing force in a direction opposite to a rotational direction of said cam, and a rotational speed of said cam is reduced by the biasing force of said spring.

6. A sheet supplying apparatus according to claim 4, wherein said regulating means comprises a friction member provided on a portion of said cam with which said sheet supporting means is slidingly contacted when said sheet supporting means is shifted from said waiting position to said supply position by the rotation of said cam, and the rotational speed of said cam is reduced by a friction force of said friction member.

7. A sheet supplying apparatus according to claim 4, wherein said cam is provided on a drive shaft of a sheet supply roller of said supply means to be rotated by one revolution in response to one revolution of said sheet supply roller, and said sheet supporting means is shifted from said waiting position to said supply position by one revolution of said cam.

8. A sheet supplying apparatus according to claim 7, wherein said drive shaft is subjected to a driving force from a drive source for driving convey means disposed at a downstream side of said supply means.

9. A sheet supplying apparatus according to claim 7, wherein one revolution clutch is provided on said drive shaft, and one revolution of said sheet supply roller is controlled by said one revolution clutch.

10. A sheet supplying apparatus according to claim 4, further comprising one revolution clutch for controlling rotation of said cam, said one revolution clutch including a first drum clutch connected to the drive shaft, a second drum clutch connected to the cam, and a spring for connecting and disconnecting said first and second drum clutches by tighting and loosing thereof, said first and second drum clutches being connected by tightening of the spring to rotate the cam.

11. A sheet supplying apparatus according to claim 4, further comprising a one revolution clutch for controlling a rotation of the cam, said one revolution clutch including a partially cut-out gear disposed between a drive shaft and the cam and a gear meshing with the partially cut-out gear, wherein drive force is transmitted to the cam to rotate it when the partially cut-out gear and the gear mesh each other and is interrupted when the gear opposes the cut-out portion.

12. A sheet supplying apparatus, comprising:

sheet supporting means for supporting a sheet and shiftable between a supply position and a waiting position;

supply means for feeding out the sheet from said sheet supporting means at said supply position;

shifting means for shifting said sheet supporting means between said supply position and said waiting position in accordance with the feeding of the sheet by said supply means; and resistance applying means for applying resistance against the shifting movement when said sheet supporting means is shifted from said waiting position to said supply position.

13. A sheet supplying apparatus according to claim 12, wherein said shifting means comprises a rotatable eccentric cam slidingly contacting with said sheet supporting means to shift said sheet supporting means between the waiting position and the supply position by rotation of said cam, and said resistance applying means comprises a regulating spring arranged to bias said cam toward a direction opposite to a rotational direction of said cam.

14. A sheet supplying apparatus according to claim 12, wherein said shifting means comprises a rotatable cam slidingly contacting with said sheet supporting means to shift said sheet supporting means between the waiting position and the supply position by rotation of said cam, and said resistance applying means comprises a friction member provided on a portion of said cam with which said sheet supporting means is slidably contacted.

15. An image forming apparatus, comprising:

image forming means for forming an image on a sheet;

sheet supporting means for supporting the sheet and shiftable between a supply position and a waiting position;

supply means for feeding out the sheet from said sheet supporting means at said supply position toward said image forming means;

biasing means for biasing said sheet supporting means from said waiting position toward said supply position;

shifting means for shifting said sheet supporting means from said supply position to said waiting position in opposition to a biasing force of said biasing means; and regulating means for regulating the shifting of said sheet supporting means with a force weaker than the biasing force of said biasing means, when said sheet supporting means is shifted from said waiting position to said supply position by said biasing means.

16. An image forming apparatus, comprising:

image forming means for forming an image on a sheet;

sheet supporting means for supporting the sheet and shiftable between a supply position and a waiting position;

supply means for feeding out the sheet from said sheet supporting means at said supply position toward said image forming means;

shifting means for shifting said sheet supporting means between said supply position and said waiting position in accordance with the feeding of the sheet by said supply means; and resistance applying means for applying resistance against the shifting movement when said sheet supporting means is shifted from said waiting position to said supply position.

* * * * *

UNITED STATES PATENT AND TRADEMARK OFFICE

CERTIFICATE OF CORRECTION

PATENT NO. : 5,358,230

DATED : October 25, 1994

INVENTOR(S) : IKUO IKEMORI, ET AL.

It is certified that error appears in the above-indentified patent and that said Letters Patent is hereby corrected as shown below:

Title Page [57] ABSTRACT:

line 5, "means" should be deleted;
line 6, "means" should be deleted;
line 8, "supporting means" should read --support--;
line 10, "device means," should read --device,--;
line 12, "means" should be deleted; and
line 14, "means" should be deleted.

Column 1:

line 15, "feed" should read --fed--.

Column 2:

line 51, "in" should be deleted.

Column 3:

line 20, "may" should read --may be--.

Column 5:

line 43, "mirror 1093," should read --mirror 109e,--.

Column 7:

line 9, "control-" should read --control--.

Column 8:

line 67, "include" should read --include a--.

UNITED STATES PATENT AND TRADEMARK OFFICE

CERTIFICATE OF CORRECTION

PATENT NO. : 5,358,230

DATED : October 25, 1994

INVENTOR(S) : IKUO IKEMORI, ET AL.

It is certified that error appears in the above-indentified patent and that said Letters Patent is hereby corrected as shown below:

Column 9:
line 35, "synchronizes" should read --synchronized--.

Column 10:
line 14, "in" should be deleted.

Column 11:
line 35, "plates" should read --plate--.

Column 15:
line 28, "in" should be deleted.

Signed and Sealed this

Eleventh Day of April, 1995

Bruce Lehman

*Attest:*

BRUCE LEHMAN

*Attesting Officer*

*Commissioner of Patents and Trademarks*